US008032046B2

(12) United States Patent
Otsuka

(10) Patent No.: US 8,032,046 B2
(45) Date of Patent: Oct. 4, 2011

(54) IMAGE FORMING DEVICE AND IMAGE FORMING METHOD WHEREIN A STANDBY FIXING TEMPERATURE IS HIGHER THAN A LOW-TEMPERATURE FIXING TEMPERATURE

(75) Inventor: Yutaka Otsuka, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 359 days.

(21) Appl. No.: 12/358,889

(22) Filed: Jan. 23, 2009

(65) Prior Publication Data

US 2009/0310998 A1 Dec. 17, 2009

(30) Foreign Application Priority Data

Jun. 11, 2008 (JP) ..... 2008-152695

(51) Int. Cl.
*G03G 15/20* (2006.01)

(52) U.S. Cl. ..... 399/69

(58) Field of Classification Search ..... 399/67, 399/69, 70
See application file for complete search history.

(56) References Cited

U.S. PATENT DOCUMENTS

| | | | |
|---|---|---|---|
| 6,185,388 | B1 | 2/2001 | Yamamoto |
| 2007/0196119 | A1 * | 8/2007 | Fujita ..... 399/68 |

FOREIGN PATENT DOCUMENTS

| | | |
|---|---|---|
| JP | 61-31463 | 7/1986 |
| JP | 4-287077 | 10/1992 |
| JP | 06-202526 | 7/1994 |
| JP | 8-36324 | 2/1996 |
| JP | 11-249489 | 9/1999 |
| JP | 2002-23554 | 1/2002 |

OTHER PUBLICATIONS

Japanese Notification of Reasons for Refusal mailed on Jun. 22, 2010, directed to counterpart Japanese Patent Application No. 2008-152695; 5 pages.

* cited by examiner

*Primary Examiner* — David Gray
*Assistant Examiner* — Joseph Wong
(74) *Attorney, Agent, or Firm* — Morrison & Foerster LLP

(57) ABSTRACT

To control a temperature of a rotating member for fixing an image during standby, an image forming device can suppress overshoot of the temperature of the rotating member occurred when a fixing state is switched to a standby state. Determining the standby temperature is higher than the fixing temperature (Step S103: YES), a CPU 61 controls a temperature of a heating roller 51 to be kept substantially at a first temperature (Step S104). After a lapse of first given time (Step S105: YES), the CPU 61 stops rotation of the heating roller 51, a fixing roller 52 and the pressure roller 54 (Step S107). The CPU 61 controls the temperature to be kept substantially at the second temperature (Step S108). After a lapse of second given time (Step S109: YES), the CPU 61 controls the temperature to be kept substantially at the standby temperature, and switches to the standby state.

12 Claims, 19 Drawing Sheets

IMAGE FORMING DEVICE AND IMAGE FORMING METHOD WHEREIN A STANDBY FIXING TEMPERATURE IS HIGHER THAN A LOW-TEMPERATURE FIXING TEMPERATURE

This application is based on application No. 2008-152695 filed in Japan, the content of which is hereby incorporated by references.

BACKGROUND OF THE INVENTION (1) Field of the Invention

The present invention relates to an image forming device that forms an image on a recording sheet having an unfixed image transferred thereon by thermally fixing the unfixed image, and relates to an image forming method executed in the image forming device.

(2) Description of the Related Art

In this kind of image forming device, when a recording sheet is carried to a fixer, a temperature of a fixing roller for heat-fixing an image is controlled. When a recording sheet is not carried to the fixer, the image forming device stands by, stopping rotation of the roller for noise abatement, energy saving and such, and controlling the temperature of the roller so as to make quick response in a case of receiving an emergent execution instruction for image formation.

Hereinafter, a preset temperature of a roller at heat-fixing is referred to as a fixing temperature, and a preset temperature of a roller on standby is referred to as a standby temperature.

FIG. 16 is a view to show a temperature transition of a roller in a conventional image forming device, and show an example when both the fixing temperature and the standby temperature indicate 180° C. Note that the bold solid line indicates a preset temperature set for the temperature control, and the thin solid line indicates a detected temperature of a circumferential surface of the roller.

As shown in FIG. 16, if the roller is stopped immediately after the completion of the fixing process (point a in FIG. 16), an amount of heat discharge is decreased and the detected temperature of the roller rises sharply (point b in FIG. 16).

The sharp rise in the detected temperature causes excessively high temperature in the roller, which may result in deterioration of members in the vicinity of the roller. Accordingly, this sharp rise in the temperature needs to be suppressed as much as possible. Hereinafter, the rise in the temperature due to this sharp rise is occasionally referred to as overshoot.

In response to the above, a conventional technique is proposed as follows. After the fixing process is completed, and before the roller is stopped, the roller is rotated without being heated for a certain period of time for heat release. After the temperature of the roller is decreased to some extent, the roller is stopped (See Japanese Unexamined Patent Application Publication H6-202526, Japanese Unexamined Patent Application Publication H11-249489).

FIG. 17 is a view to show temperature transition of the roller on the assumption that the above conventional technique is applied, and shows an example in which both the fixing temperature and the standby temperature are 180° C., and in which the temperature is once decreased to 155° C. after the fixing process.

As shown in FIG. 17, after the completion of the fixing process, the preset temperature is decreased to 155° C. with the roller kept rotating (point a in FIG. 17). Following this, the rotation of the roller is stopped, and the operation is switched to be in the standby state (point b in FIG. 17), and the temperature is controlled to be 180° C. which is the standby temperature. Then, the detected temperature rises sharply. However, compared with the case in which the control is not performed (FIG. 16), the peak temperature (point c in FIG. 17) of the increasing temperature can be kept low.

However, the fixing temperature is usually changed according to an environmental temperature, a type of a recording sheet and such. The aforementioned control is effective when the fixing temperature is set as high as or higher than the standby temperature. However, the fixing temperature is set lower than the standby temperature and accordingly there is a large gap between the fixing temperature and the preset temperature, which presents new problems of the overshoot.

The following is a detailed explanation of the problems.

FIG. 18 shows an example in which the fixing temperature is 145° C. and the standby temperature is 190° C.

In this case, as shown in FIG. 18, after the completion of the fixing process, the preset temperature is decreased to 120° C. with the roller kept rotating (point a in FIG. 18). Following this, the preset temperature is increased to 190° C. and the temperature control is started (point b in FIG. 18). However, since the preset temperature is significantly increased from 120° C. to 190° C. at the point b in FIG. 18, the detected temperature overshoots to a large extent (point c in FIG. 18).

This overshoot causes excessively high temperature of the roller, which may deteriorates members in the vicinity of the roller. Accordingly, it is necessary to suppress this overshoot as much as possible.

In addition, if the control shown in FIG. 18 is not performed, as shown in FIG. 19, when the preset temperature (145° C.) for fixing is much lower than the preset temperature (190° C.) in the standby state, the following occurs. If the rotation of the roller is stopped immediately after the completion of the fixing process (point a in FIG. 19), the temperature of the roller rises, and the image forming device is switched to be in a standby state and controls the temperature of the roller to be 190° C., which results in heating the roller. Thus, the detected temperature overshoots to a large extent (point b in FIG. 19).

SUMMARY OF THE INVENTION

The object of the present invention is therefore to provide an image forming device as follows. During standby, when the temperature is controlled to be a given standby temperature with the rotating members for fixing an image controlled to stop, if the fixing temperature is set lower than the standby temperature, the image forming device can suppress overshoot occurred in the temperature of the rotating members when the fixing state is switched to the standby state.

To solve the above problem, one aspect of the present invention provides an image forming device that thermally fixes an unfixed image onto a recording sheet having the unfixed image formed thereon, by passing the recording sheet through a fixing nip between a pair of rotating members for applying pressure to the recording sheet, wherein in a standby state, rotation of the pair of the rotating members is controlled to stop, and a temperature of at least one of the pair of the rotating members is controlled to be kept substantially at a given standby temperature, and in a low-temperature fixing state, the pair of the rotating members is controlled to rotate, and the temperature is controlled to be kept substantially at a lower temperature than the standby temperature, the image forming device includes a determiner operable to determine whether to switch from the low-temperature fixing state to the standby state, and a controller operable, if the determination is affirmative, to control the temperature to be kept substantially at a temperature being intermediate between the lower temperature and the standby temperature, and subsequently to control the temperature to be kept substantially at the standby temperature.

To solve the above problem, another aspect of the present invention provides an image forming method used by an image forming device that thermally fixes an unfixed image onto a recording sheet having the unfixed image formed thereon, by passing the recording sheet through a fixing nip between a pair of rotating members for applying pressure to the recording sheet, wherein in a standby state, rotation of the pair of the rotating members is controlled to stop, and a temperature of at least one of the pair of the rotating members is controlled to be kept substantially at a given standby temperature, and in a low-temperature fixing state, the pair of the rotating members is controlled to rotate, and the temperature is controlled to be kept substantially at a lower temperature than the standby temperature, the image forming method includes a determination step of determining whether to switch from the low-temperature fixing state to the standby state; and a control step of, if the determination is affirmative, controlling the temperature to be kept substantially at a temperature being intermediate between the lower temperature and the standby temperature, and subsequently controlling the temperature to be kept substantially at the standby temperature.

With the above features, when the low-temperature fixing state where the fixing temperature is lower than the standby temperature is switched to the standby state, the image forming device controls the temperature to be a temperature being intermediate between the fixing temperature and the standby temperature. Thus, the preset temperature is not sharply but gradually increased to the standby temperature as follows. The preset temperature is increased to the intermediate temperature, and subsequently, the intermediate temperature is further increased to the standby temperature. Thus, the overshoot that occurs at the temperature rise of the rotating member can be suppressed. As a result, the deterioration of the members in the vicinity of the roller is suppressed.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

The following describes embodiments of the present invention, with the reference to the attached drawings.

Embodiment 1

First, a description is made on an image forming device 1 in accordance with Embodiment 1 of the present invention.

(1. Structure)

(1-1. Basic Structure)

Figure 1:
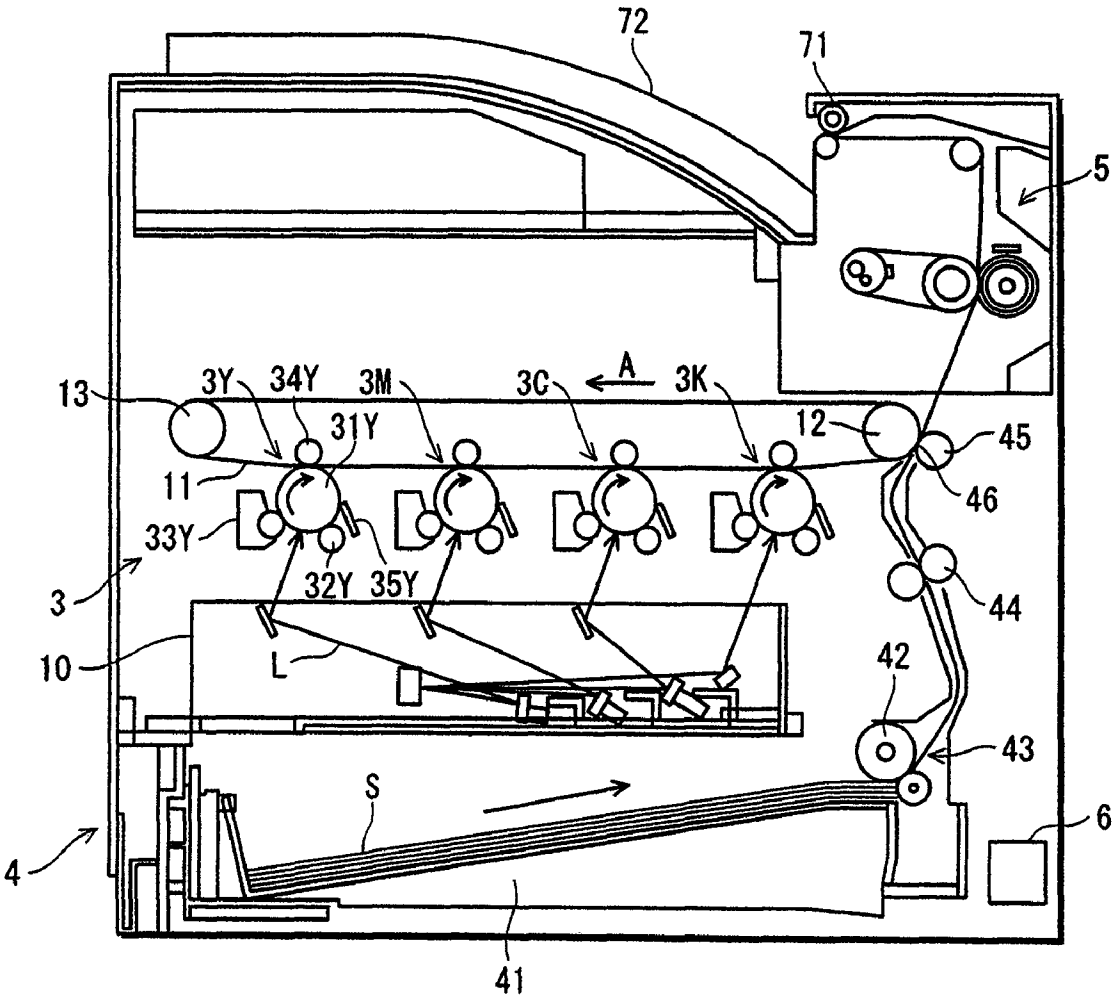
FIG. 1 is a view showing an outline structure of an image forming device 1, according to Embodiment 1 of the present invention.

With the reference to FIG. 1, a description is made on an outline structure of an image forming device 1 which is a tandem-type color printer.

As shown in FIG. 1, the image forming device 1 includes an image processor 3, a feeder 4, a fixer 5, and a controller 6. The image forming device 1 is connected to a network (e.g. LAN), and upon receiving an image forming execution instruction from an unillustrated external terminal apparatus, executes color image formation in accordance with the instruction, the color image being composed of colors yellow, magenta, cyan, and black. The yellow, magenta, cyan and black reproduction colors are hereinafter represented as Y, M, C, and K respectively, and the letters Y, M, C, and K have been appended to numbers of elements pertaining to the reproduction colors.

The image processor 3 includes image formers 3Y, 3M, 3C, and 3K corresponding to the colors Y to K respectively, an optical part 10, and an intermediate transfer belt 11.

The image former 3Y includes a photoreceptor drum 31Y, and a charger 32Y, a developer 33Y, a primary transfer roller 34Y, a cleaner 35Y for cleaning the photoreceptor drum 31Y, and the like are disposed surrounding the photoreceptor drum 31Y. The image former 3Y forms a color Y toner image on the photoreceptor drum 31Y. Other image farmers 3M, 3C and 3K also have similar structures to the image former 3Y, and reference notations thereof are omitted in FIG. 1.

The optical part 10 includes a luminous element such as a laser diode, and emits a laser beam L for exposing the photoreceptor drums 31Y to 31K.

The intermediate transfer belt 11 is an endless belt that is suspended in a tensioned state on a driving roller 12 and a driven roller 13, and is rotated in the direction of arrow A.

The feeder 4 includes a paper feed cassette 41 that contains a sheet S as a recording sheet, a feeding roller 42 that feeds the sheet S of the paper feed cassette 41 on a conveyance path 43 one sheet at a time, a timing roller pair 44 for adjusting a timing at which to send the fed sheet S to a secondary transfer position 46, a secondary transfer roller 45, and so on.

The controller 6 converts an image signal transmitted from the unillustrated external terminal apparatus into digital signals for colors Y to K, and generates a driving signal for driving the luminous element of the optical part 10.

In accordance with a driving signal from the controller 6, the optical part 10 emits the laser beam L for image formation in colors Y to K, and scans the laser beams across the photoreceptor drums 31Y to 31K. This exposure scanning forms electrostatic latent images on the photoreceptor drums 31Y to 31K that have been uniformly charged by the chargers 32Y to 32K. The electrostatic latent images are developed by the developers 33Y to 33K, and toner images of colors Y to K are formed on the photoreceptor drums 31Y to 31K. The color toner images are sequentially transferred to the intermediate transfer belt 11 by electrostatic power acting on the primary transfer rollers 34Y to 34K. At this time, the image forming operation for each color is executed at different timings so that the toner images are superimposed on the same position on the intermediate transfer belt 11. The toner images for each color that have been superimposed on the intermediate transfer belt 11 are transported by the rotation of the intermediate transfer belt 11 to the secondary transfer position 46.

Meanwhile, the sheet S is fed from the feeder 4 via the timing roller pair 44 at the timing of transport by the intermediate transfer belt 11. The sheet S is conveyed sandwiched between the rotating intermediate transfer belt 11 and the secondary transfer roller 45. The toner images on the intermediate transfer belt 11 are collectively secondarily transferred to the sheet S by electrostatic power acting on the secondary roller 45.

The sheet S that has passed the secondary transfer position 46 is conveyed to the fixer 5. The toner images on the sheet S (unfixed images) are fixed thereto by heat and pressure.

The sheet S to which the toner images are fixed is discharged to the discharge tray 72 via a discharge roller pair 71.

Thus, the image forming device-1 forms an image on a sheet by executing the steps of charging, scanning, developing, transferring, fixing, cleaning and removing electricity.

(1-2. Structure of Fixer 5)

Figure 2:
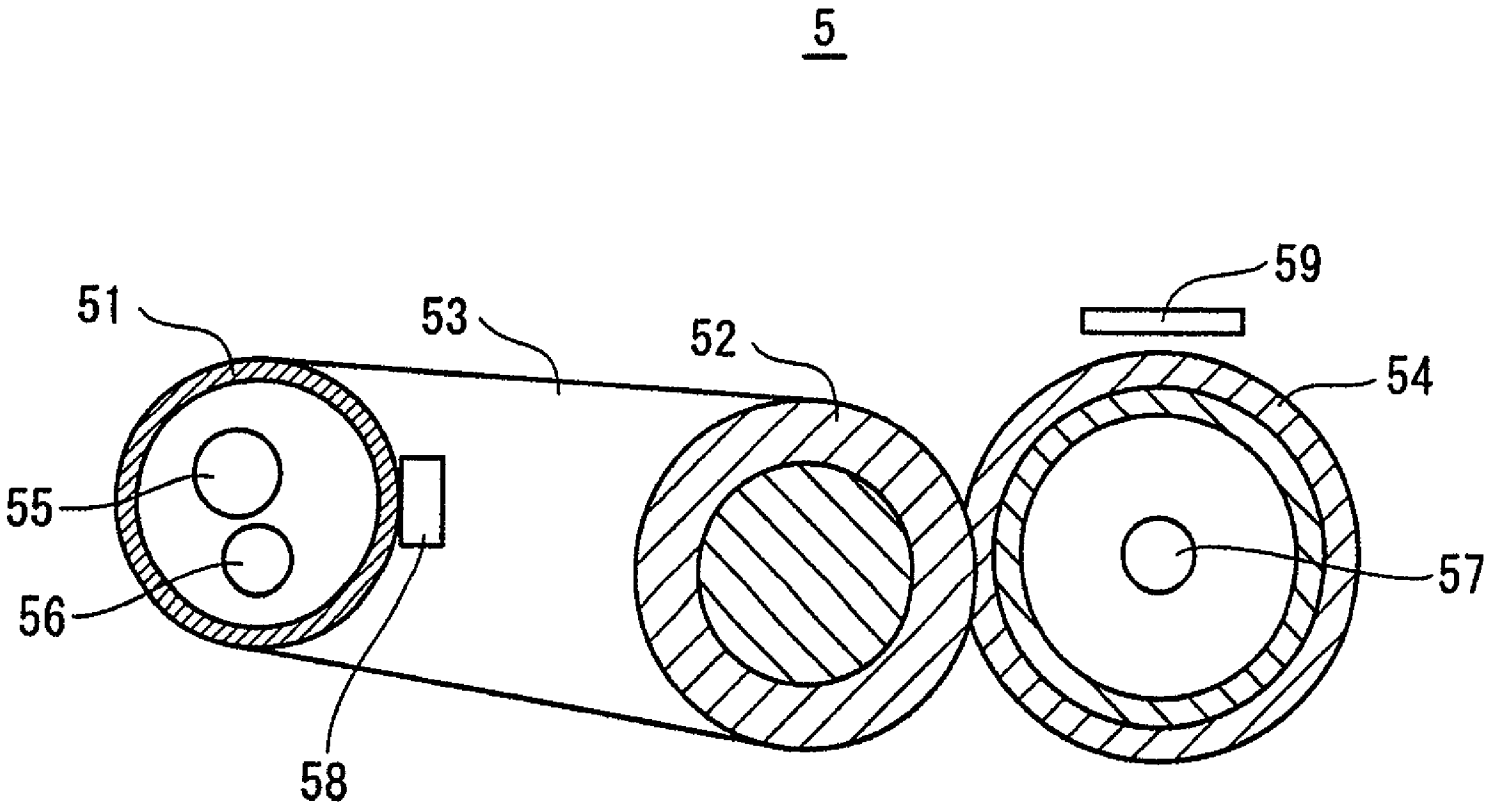
FIG. 2 is a cross-sectional view showing a outline structure of a fixer 40.

With the reference to FIG. 2, a description is made on an outline structure of the fixer 5.

As shown in FIG. 2, in the fixer 5, a pressure roller 54 is arranged adjacent to a fixing belt 53 that is wound around a heating roller 51 and a fixing roller 52. A fixing nip is formed at a portion at which the fixing belt 53 and the pressure roller contact each other.

The heating roller 51 is a cylindrical steel or aluminum pipe whose surface is laminated with a releasing layer made of fluorine resin and the like (e.g. outer diameter 25 mm, aluminum hollow core 0.6 mm+PTFE coat 15 μm, nip longitudinal direction approximately 330 mm).

Into the heating roller 51, a long heater 55 (e.g. halogen lamp heater 990 W, light emission length 290 mm) and a short heater 56 (e.g. halogen lamp heater 790 W, light emission length 180 mm) are inserted. The heating roller 51 is heated by heat generation of the long heater 55 or the short heater 56. The generated heat is conducted to the fixing belt 53, and thereby heating the fixing belt 53.

The fixing roller 52 is a cylindrical steel or aluminum pipe whose surface is laminated with an elastic layer such as silicon rubber, and sponge (e.g. outer diameter 30 mm, steel solid core ϕ22 mm+rubber 4 mm+sponge 2 mm, nip longitudinal direction approximately 330 mm).

The fixing belt 53 is a bendable endless belt having a tubular heat-resistant layer made of polyimide resin, nickel-based material and the like whose surface is laminated with a releasing layer made of fluorine resin and the like and an elastic layer such as silicon rubber (e.g. outer diameter 60 mm, nickel-based material 45 μm+rubber 200 μm+PFA 30 μm, nip longitudinal direction approximately 320 mm).

The pressure roller 54 is a cylindrical steel or aluminum pipe whose surface is laminated with a releasing layer made of fluorine resin and the like and an elastic layer such as silicon rubber (e.g. outer diameter 35 mm, steel hollow core 2.5 mm+rubber 2.5 m +PFA 30 μm, nip longitudinal direction approximately 330 mm). The pressure roller 54 is rotated in accordance with a speed of a passing sheet. The torque of the pressure roller 54 drives to rotate the fixing belt 53 touching the pressure roller 54, the fixing roller 52 and the heating roller 51 around which the fixing belt 53 is wound.

Into the pressure roller 54, the pressure heater 57 (e.g. halogen lamp heater 230 W, light emission length 290 mm) is inserted. The pressure roller 54 is heated by heat generation of the pressure heater 57.

The fixer 5 has a heating roller side thermistor 58 and a pressure roller side thermistor 59.

The heating roller side thermistor 58 is located at a point to detect a surface temperature of the heating roller 51 (e.g. arranged to be contacted with two points that are 40 mm and 140 mm away from the central point of where a sheet passes)

The pressure roller side thermistor 59 is located at a point to detect a surface temperature of the pressure roller 54 (e.g. arranged in a contactless manner at a point that is 40 mm away from the central point of where a sheet passes).

(1-3. Internal Structure)

Figure 3:
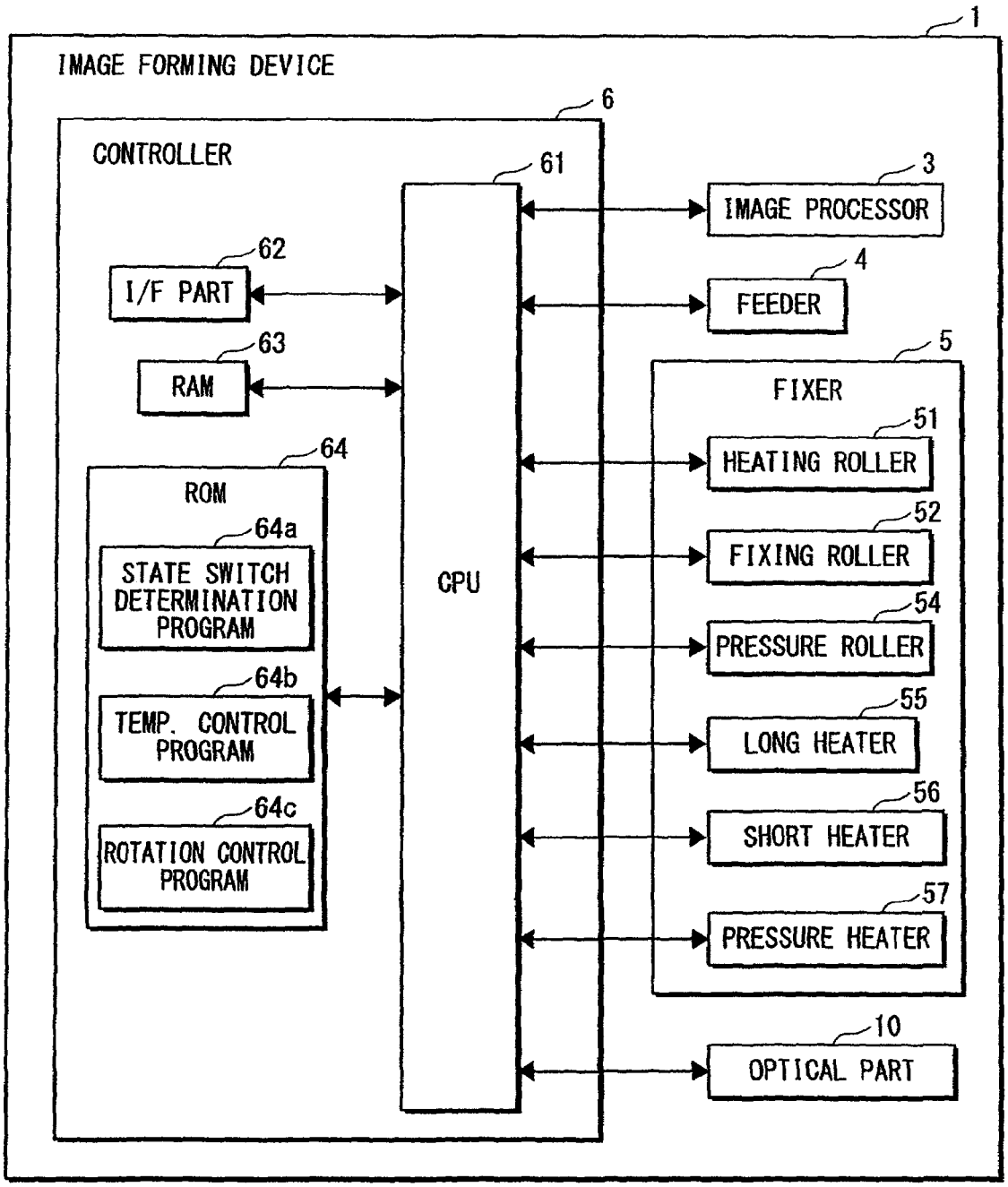
FIG. 3 is a block diagram showing an internal structure of the image forming device 1.

With the reference to FIG. 3, a description is made on an internal structure of the image forming device 1, and relation between the controller 6 and other respective devices.

As shown in FIG. 3, inside the image forming device 1, the image processor 3, the feeder 4, the fixer 5 and the optical part 10 are connected to the controller 6.

The controller 6 includes a CPU (Central Processing Unit) 61, an I/F (interface) part 62, a RAM (Random Access Memory) 63, and a ROM (Read Only Memory) 64.

The CPU 61 reads programs from the ROM 64, and causes execution of each operation.

The I/F part 62 is a device that connects the CPU 61 and a network such as LAN, and more specifically, can be realized by a LAN card, a LAN board and the like. The I/F part 62 receives an execution instruction for image formation from an external unit, and transmits the execution instruction to the CPU 61.

The RAM 63 holds data and such that are necessary when the CPU 61 executes a program. Particularly, the RAM 63 holds a fixing temperature that is a target temperature of the heating roller 51 in a fixing state and standby temperatures that are target temperatures of the heating roller 51 and the pressure roller 54 on standby. The fixing temperature of the heating roller 51 is different from that of the pressure roller 54, and a value of the fixing temperature differs according to a type of a sheet. A fixing state in which a fixing temperature lower than a standby temperature is selected is referred to as "low-temperature fixing state," whereas a fixing state in which a fixing temperature equal to or higher than a standby temperature is selected is referred to as "high-temperature fixing state."

This embodiment illustrates an example in which a fixing temperature of the heating roller 51 to fix an image on plain paper is set as 145° C. and of the pressure roller 54 is set as 135° C. In addition, the standby temperature of the heating roller 51 is different from that of the pressure roller 54. This embodiment illustrates an example in which a standby temperature of the heating roller 51 is set as 185° C. and of the pressure roller 54 is set as 135° C.

The ROM 64 holds a program executed by the CPU 61 to control the image forming device 1. Particularly, the ROM 64 holds a state switch determination program 64*a*, a temperature control program 64*b*, and a rotation control program 64*c*.

The state switch determination program 64*a* determines whether to switch from a low-temperature fixing state to a standby state according to an execution instruction for image formation received from an external unit.

During warm-up or standby, the temperature control program 64*b* controls the temperature of the heating roller 51 to be the standby temperature held by the RAM 63 by controlling ON/OFF of each of the long heater 55 and the short heater 56. In addition, the temperature control program 64*b* controls the temperature of the pressure roller 54 by controlling ON/OFF of the pressure heater 57. In addition, in order to fix an image, the temperature control program 64*b* controls the temperature of the heating roller 51 to be the fixing temperature held by the RAM 63 by controlling ON/OFF of each of the long heater 55 and the short heater 56.

In addition, the temperature control program 64*b* controls the temperature of the heating roller 51 as follows. During the warm-up, the temperature control program 64*b* obtains a first warm-up intermediate temperature (first WU intermediate temperature) and a second warm-up intermediate temperature (second WU intermediate temperature) by calculating two temperatures each being intermediate between a detected temperature of the heating roller side thermistor 58 and a standby temperature of the heating roller 51 at the power activation. The temperature control program 64*b* controls the temperature of the heating roller 51 to be kept substantially at each of the intermediate temperatures by controlling ON/OFF of the long heater 55 and the short heater 56. In addition, the temperature control program 64*b* controls the temperature of the pressure roller 54 as follows. The temperature control program 64*b* obtains a first WU intermediate temperature and a second WU intermediate temperature by calculating two temperatures each being intermediate between a detected temperature of the pressure roller side thermistor 59 and a standby temperature of the pressure roller 54 at the power activation. The temperature control program 64*b* controls the temperature of the heating roller 51 to be kept substantially at each of the intermediate temperatures, by controlling ON/OFF of the pressure roller 57. Herein, the first WU intermediate temperature may be a temperature being intermediate between the detected temperature and the standby temperature. For example, a value which is the fixing temperature plus 25% of a difference value between the fixing temperature and the standby temperature may be calculated as the first WU intermediate temperature. Similarly, the second WU intermediate temperature may be a temperature intermediate between the fixing temperature and the standby temperature. For example, a value which is the first intermediate temperature plus 50% of a difference value between the first intermediate temperature and the standby temperature may be calculated as the second WU intermediate temperature.

Furthermore, when an image is fixed at a low temperature by controlling ON/OFF of each of the long heater 55 and the short heater 56, the temperature control program 64*b* controls the temperature of the heating roller 51 to be kept substantially at the first intermediate temperature and then the second intermediate temperatures that are obtained by calculating two temperatures each being intermediate between the fixing temperature and the standby temperature. This embodiment illustrates an example in which the first WU intermediate temperature is the fixing temperature plus 25% of the difference value between the fixing temperature and the standby temperature, and in which the second WU intermediate temperature is the fixing temperature plus 50% of the difference value.

In the warm-up state, the standby state, the fixing state, and a state between the standby state and the fixing state, the rotation control program 64*c* controls to execute or stop the rotation of each of the heating roller 51, the fixing roller 52 and the pressure roller 54.

(2. Operation)

Subsequently, with the reference to flowcharts shown in FIGS. 4 and 5, a description is made on warm-up operation before the image forming operation in the image forming device 1, and operation during and after the image forming operation.

Note that this embodiment illustrates an example in which an image is formed on plain paper.

Figure 4:
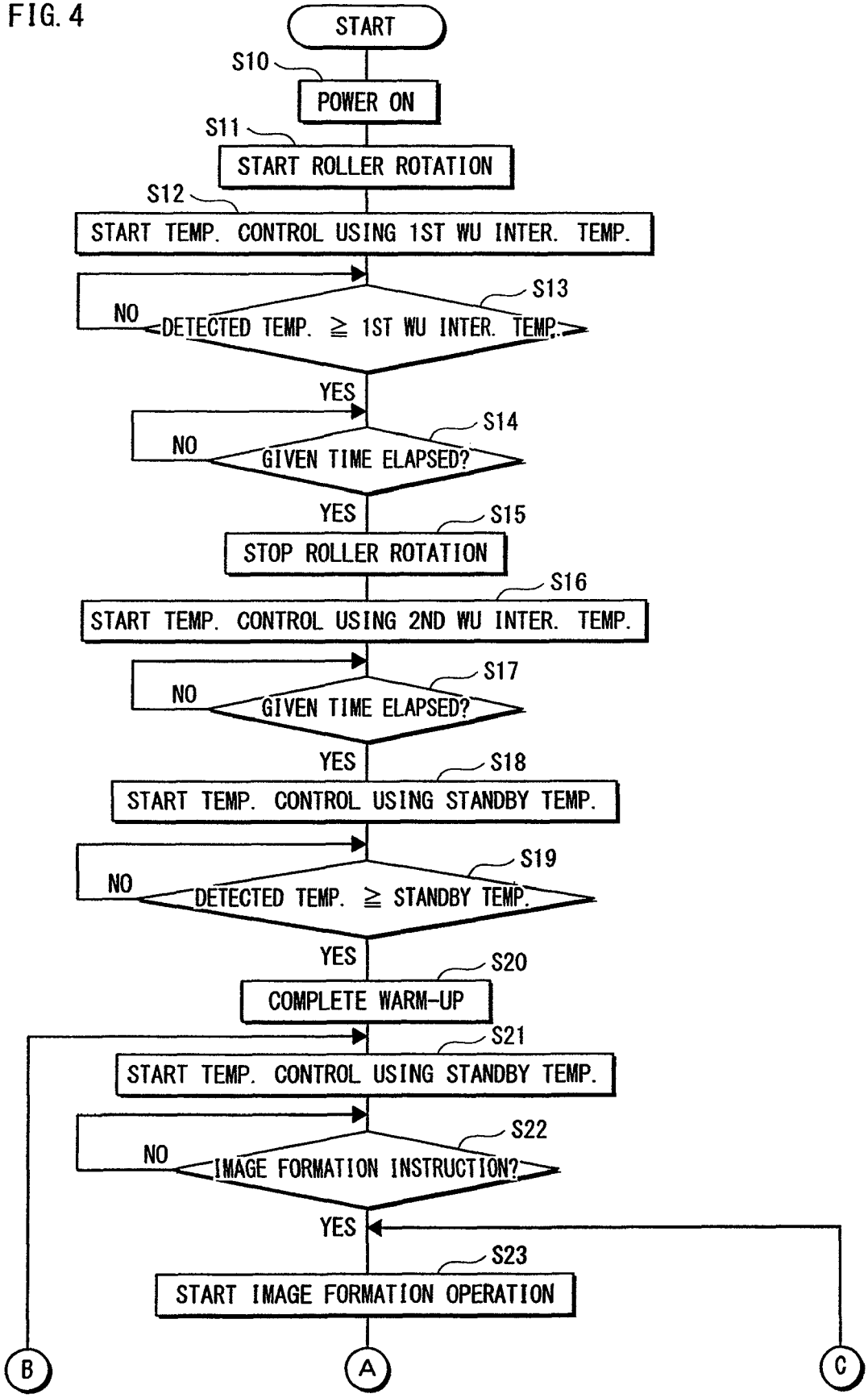
FIG. 4 is a flowchart showing warm-up operation before image forming operation, according to the image forming device
Figure 5:
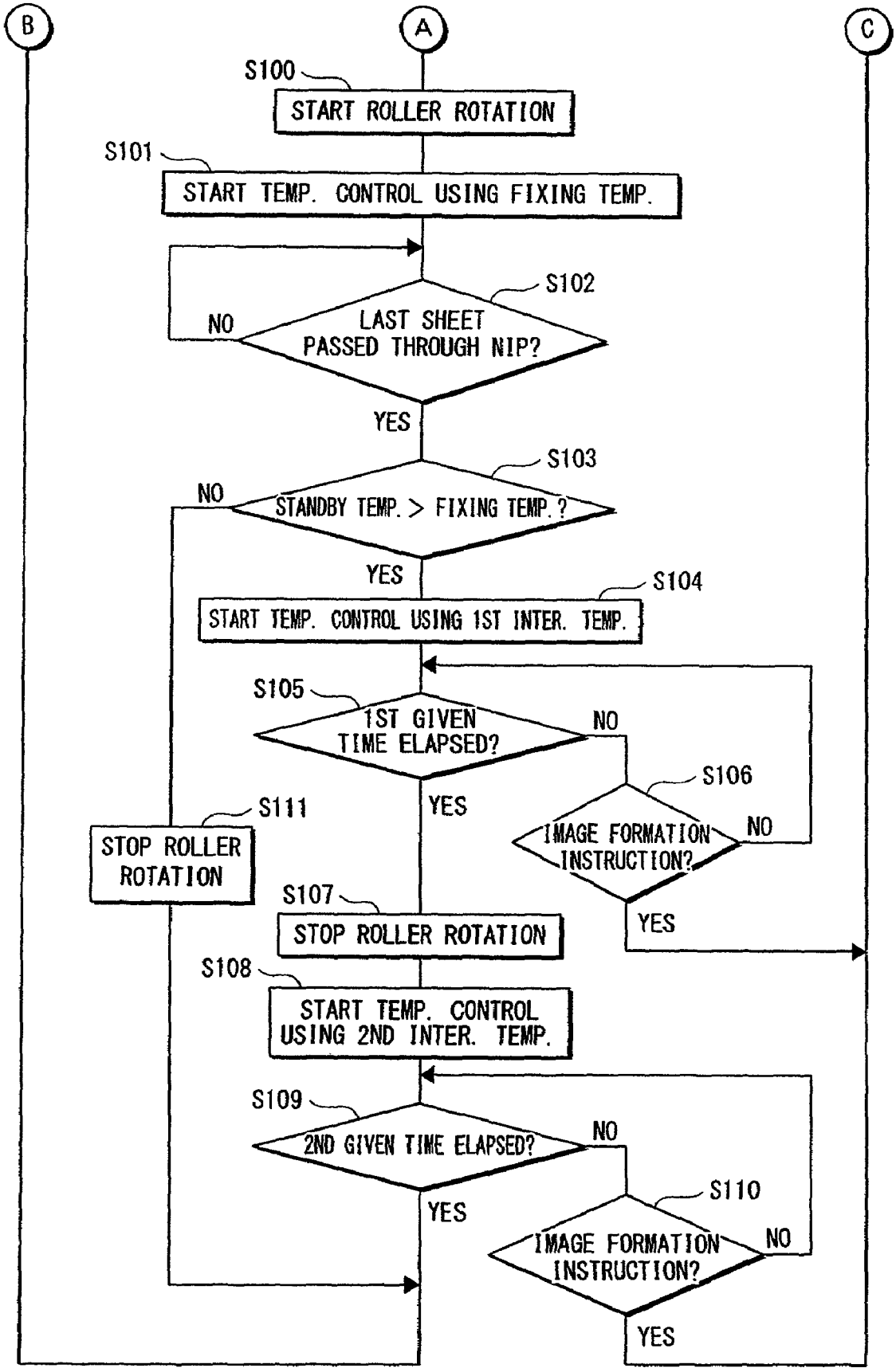
FIG. 5 is a flowchart showing operation during and after the image forming operation, according to the image forming device 1.

As shown in FIG. 4, when the image forming device 1 is powered on (Step S1), the controller 6 drives to rotate the pressure roller 54 by transmitting driving force to an unillustrated drive gear, which consequently drives to rotate the fixing belt 53, the fixing roller 52, and the heating roller 51. Accordingly, heat of the heating roller 51 and the pressure roller 54 is transmitted to the fixing belt 53 and a surface of the pressure roller 54 (Step S11).

Subsequently, the CPU 61 executes the temperature control program 64*b*, and calculates the first WU intermediate temperature (first WU intermediate temperature of the heating roller side) being intermediate between the detected temperature of the heating roller side thermistor 58 and 185° C. which is the standby temperature. The CPU 61 starts to control the temperature of the heating roller 51 to be kept substantially at the first WU intermediate temperature of the heating roller side. In addition, the CPU 61 calculates the first WU intermediate temperature (first WU intermediate temperature of the pressure roller side) being intermediate between the detected temperature of the pressure roller side thermistor 59 and 135° C. which is the standby temperature. The CPU 61 starts to control the temperature of the pressure roller 54 to be kept substantially at the first WU intermediate temperature of the pressure roller side (Step S12).

When the detected temperature of the heating roller side thermistor 58 is equal to or higher than the first WU intermediate temperature of the heating roller side, and when the detected temperature of the pressure roller side thermistor 59 is equal to or higher than the first WU intermediate temperature of the pressure roller side (Step S13: YES), following that the detected temperature is stabilized after a lapse of given time (Step S14), the rotation of each of the heating roller 51 and the pressure roller 54 is stopped (Step S15).

Subsequently, the CPU 61 calculates, for the heating roller 51, the second WU intermediate temperature (second WU intermediate temperature of the heating roller side) being intermediate between the first WU intermediate temperature of the heating roller side and 185° C. which is the standby temperature. The CPU 61 starts to control the temperature of the heating roller 51 to be kept substantially at the second WU intermediate temperature of the heating roller side. In addition, the CPU 61 calculates, for the pressure roller 54, the second WU intermediate temperature (second WU intermediate temperature of the pressure roller side) being intermediate between the first WU intermediate temperature of the pressure roller side and 135° C. which is the standby temperature. The CPU 61 starts to control the temperature of the pressure roller 54 to be kept substantially at the second WU intermediate temperature of the pressure roller side (Step S16).

After a lapse of given time necessary for stabilizing the temperature control (Step S17: YES), the CPU 61 changes the preset temperature for controlling the temperature of the heating roller 51 to the standby temperature of the heating roller 51, 185° C. The CPU 61 starts to control the temperature of the heating roller 51 to be kept substantially at 185° C. which is the standby temperature. In addition, the CPU 61 changes the preset temperature for controlling the temperature of the pressure roller 54 to 135° C. which is the standby temperature thereof, and starts to control the temperature of the pressure roller 54 to be kept substantially at 135° C. which is the standby temperature (Step S18).

The temperature detected by the heating roller side thermistor 58 reaches 185° C. which is the standby temperature thereof, and the temperature detected by the pressure roller side thermistor 59 reaches 135° C. which is the standby temperature thereof (Step S19: YES), the warm-up operation is completed and the operation is switched to be in the standby state (Step S20).

Described as above, by raising the temperatures of the heating roller 51 and the pressure roller 54 to the respective standby temperatures thereof during the warm-up, the detected temperatures of the heating roller 51 and the pressure roller 54 are prevented from overshooting. Note that the aforementioned warm-up operation is merely an example, and other warm-up operations are also applicable.

During standby, till receiving the execution instruction for image formation from the external unit (Step S22: NO), the CPU 61 executes the temperature control program 64*b*, and controls the temperatures of the heating roller 51 and the pressure roller 54 to be kept substantially at the respective standby temperatures that are 185° C. and 135° C. (Step S21).

When receiving the execution instruction for image formation (Step S22: YES), the controller 6 issues an instruction to start image forming operation to the image processor 3, the feeder 4, the fixer 5, the optical part 10 and the like, and accordingly the image forming device 1 starts the image forming operation (Step S23).

When the image forming operation is started, the CPU 61 executes the rotation control program 64*c*, thereby starting the rotation of each of the heating roller 51, the fixing roller 52 and the pressure roller 54 (Step S100). More specifically, after the start of the image forming operation, the rotation may be started immediately before the first sheet is carried to the fixer 5. Note that, herein, a linear speed of the fixer 5 is 45 mm/s.

The CPU 61 that executes the temperature control program 64*b* controls the temperatures of the heating roller 51 and the pressure roller 54 to be kept substantially at 145° C. and 135° C., respectively, which are fixing temperatures thereof for plain paper (Step S101). Note that it depends on a size of the paper whether to use the long heater 55 or the short heater 56 for controlling the temperature of the heating roller 51. For example, when a width of the paper is 216 mm or less, the short heater 56 is used, and when a width of the paper is more than 216 mm, the long heater 55 is used.

In addition, during the image forming operation, the CPU 61 also executes the state switch determination program 64*a*.

Until the last sheet S on which an image is formed has passed through the nip in the fixer 5 (Step S102: NO), which is to say, during the execution of the image forming operation, Step S101 is repeated.

On the other hand, when the image forming operation is completed and when the last sheet has passed through the nip (Step S102: YES), by determining whether the standby temperature is higher than the fixing temperature, the CPU 61 determines whether to switch from the low-temperature fixing state in which the fixing temperature is lower than the standby temperature to the standby-state (Step S103).

When the CPU 61 determines to switch from the low-temperature fixing state in which the fixing temperature lower than the standby temperature to the standby state (Step S103: YES), the CPU 61 calculates the first intermediate temperature and controls the temperatures of the heating roller 51 to be kept substantially at the first intermediate temperature (Step S104).

Until first given time has elapsed since the start of the control of the temperature to be kept substantially at the first intermediate temperature (Step S105: NO), if the CPU 61 does not receive the execution instruction for image formation (Step S106: NO), the CPU 61 continues to control the temperature to be kept substantially at the first intermediate temperature.

Note that the first given time is from the start of the control of the detected temperature of the heating roller 51 to be kept substantially at the first intermediate temperature till the detected temperature begins to be kept substantially at the first intermediate temperature, which may be determined beforehand by experimental measurement. The first given time may be held by the RAM 63.

After the lapse of the first given time (Step S105: YES), the CPU 61 executes the rotation control program 64*c* and stops the rotation of each of the heating roller 51, the fixing roller 52 and the pressure roller 54 (Step S107). The CPU 61 calculates the second intermediate temperature, and controls the temperature of the heating roller 51 to be kept substantially at the second intermediate temperature (Step S108).

Until the second given time has elapsed since the start of the control of the temperature to be kept substantially at the second intermediate temperature (Step S109: NO), if the CPU 61 does not receive the execution instruction for image formation (Step S110: NO), the CPU 61 continues to control the temperature to be kept substantially at the second intermediate temperature.

Note that the second given time is from the start of the control of the temperature of the heating roller 51 to be kept substantially at the second intermediate temperature till the detected temperature begins to be kept substantially at the second intermediate temperature, which may be determined beforehand by experimental measurement. The second given time may be held by the RAM 63.

After the lapse of the second given time (Step S109: YES), the operation goes to Step 21. The CPU 61 starts to control the temperature to be kept substantially at the standby temperature, and the operation is switched to be in the standby state.

On the other hand, when the CPU 61 determines that the fixing temperature is equal to or higher than the standby temperature in Step S103 (Step S103: NO), instead of executing the process of Steps S104-S110, the CPU 61 stops the rotation of each of the heating roller 51, the fixing roller 52 and the pressure roller 54 (Step S111), and switches the operation to be in the standby state.

Note that by applying the techniques shown in the conventional techniques (Japanese Unexamined Patent Application Publications H6-202526 and H11-249489), prior to the stop of the rotation of each roller in Step S111, control may be performed to suppress the temperatures of the rollers that rise when the roller rotation stops, such as idling the rollers for given time by turning off the long heater 55 or the short heater 56. When such control is performed, in comparing the standby temperature and the fixing temperature in Step S103, the determination is made on whether the fixing temperature is higher than the standby temperature by a given temperature range. The given temperature may be determined by experiments and the like, based on a temperature difference between the standby temperature and the fixing temperature that can better suppress the temperature overshoot of the roller with the use of the intermediate temperature.

Operated as above, according to the image forming device 1, in a case where the fixing temperature is set lower than the standby temperature, when the fixing state is switched to the standby state, the operation is not switched to be in the standby state immediately after the stop of the roller rotation. Instead, the image forming device 1 controls the temperature of the roller to be kept substantially at the first intermediate temperature, with the roller kept rotating, and subsequently stops the rotation of the roller and controls the temperature of the roller to be kept substantially at the second intermediate temperature. Following that, the fixing state has been switched to the standby state and the temperature is controlled to be kept substantially at the standby temperature.

Figure 6:
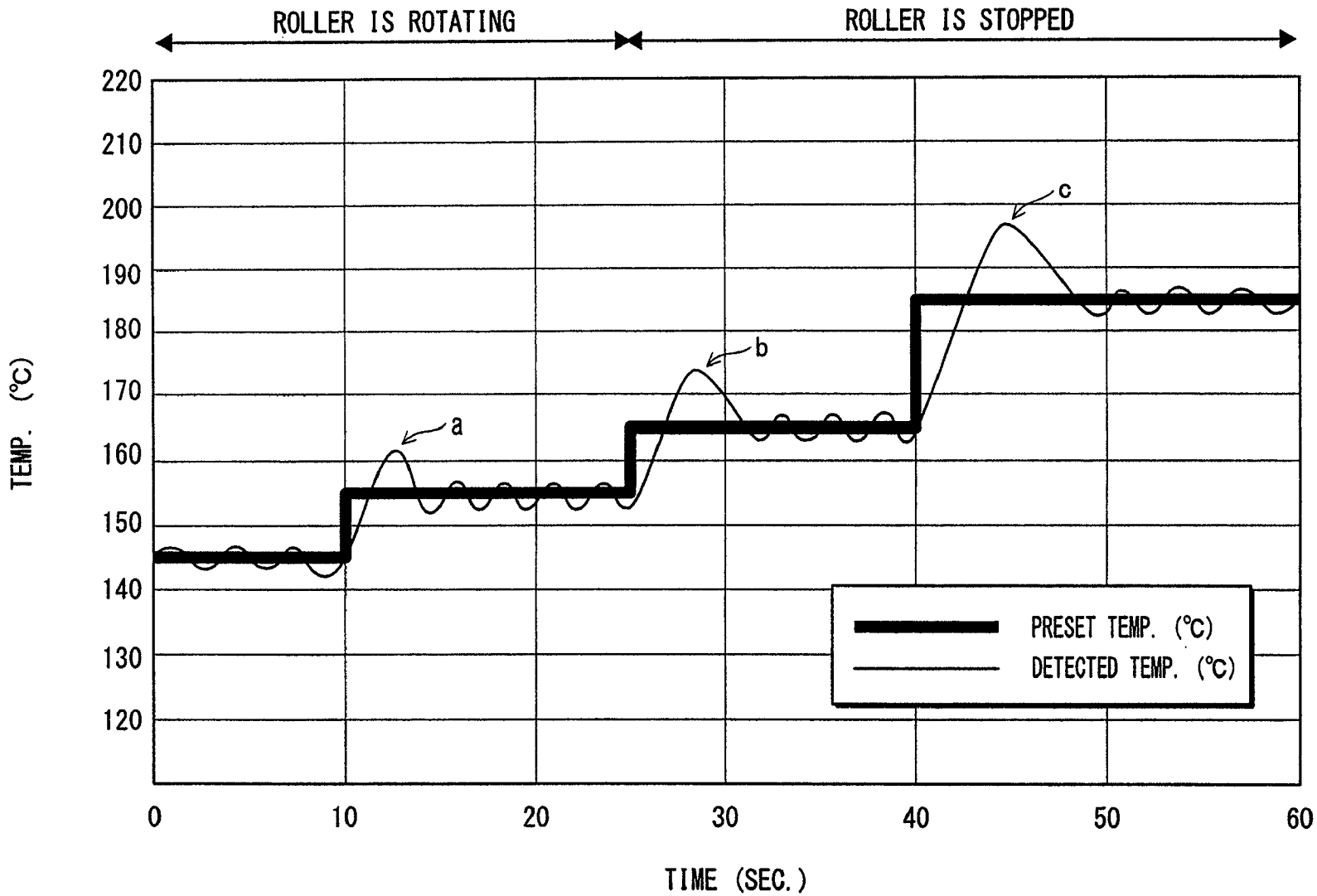
FIG. 6 is a graph showing transition of a temperature of a heating roller 51, according to the image forming device 1.

With the reference to transition of a temperature of the heating roller 51 shown in FIG. 6, a description is made on an effect of the operation performed by the image forming device 1.

It is supposed that zero second is set as the starting point, and that the fixing process is completed after ten seconds.

After the completion of the fixing process, the temperature of the heating roller 51 is started to be controlled to be kept substantially at the preset temperature, 155° C., with the heating roller 51 kept rotating. At this time, since the roller is rotating, a large amount of the heat is radiated. In addition, the preset temperature is slightly changed by approximately 10° C. from 145° C. to 155° C. Accordingly, although the detected temperature overshoots, a gap between the detected temperature and the preset temperature is suppressed by approximately 5° C. (point a in FIG. 6).

Following this, after a lapse of 15 seconds (equivalent to the first given time), the rotation of the heating roller 51 is stopped and the temperature is controlled to be kept substantially at 165° C. which is the preset temperature thereof. At this time, since the preset temperature is slightly changed by approximately 10° C. from 155° C. to 165° C., although the detected temperature overshoots, a gap between the detected temperature and the preset temperature is suppressed by approximately 10° C. (point b in FIG. 6).

Following this, after a lapse of 15 seconds (equivalent to the second given time), the fixing state is switched to the standby state, and the temperature is controlled to be kept substantially at 185° C. which is the preset temperature thereof. At this time, since the preset temperature is slightly changed by approximately 20° C. from 165° C. to 185° C., although the detected temperature overshoots, a gap between the detected temperature and the preset temperature can be suppressed by approximately 10° C. (point c in FIG. 6).

Figure 16:
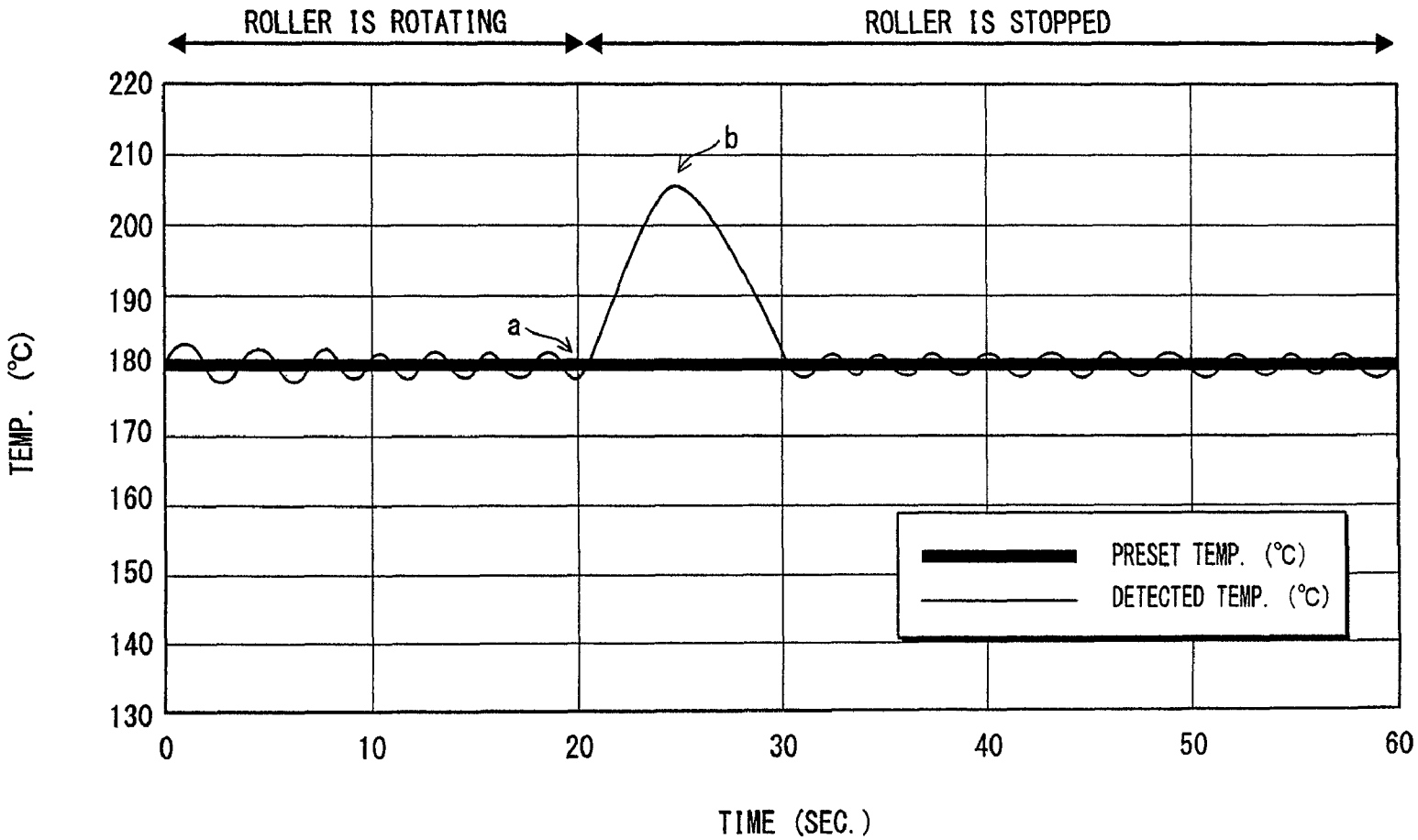
Prior Art FIG. 16
FIG. 16 is a first graph showing transition of a temperature of a roller, according to a conventional image forming device.
Figure 17:
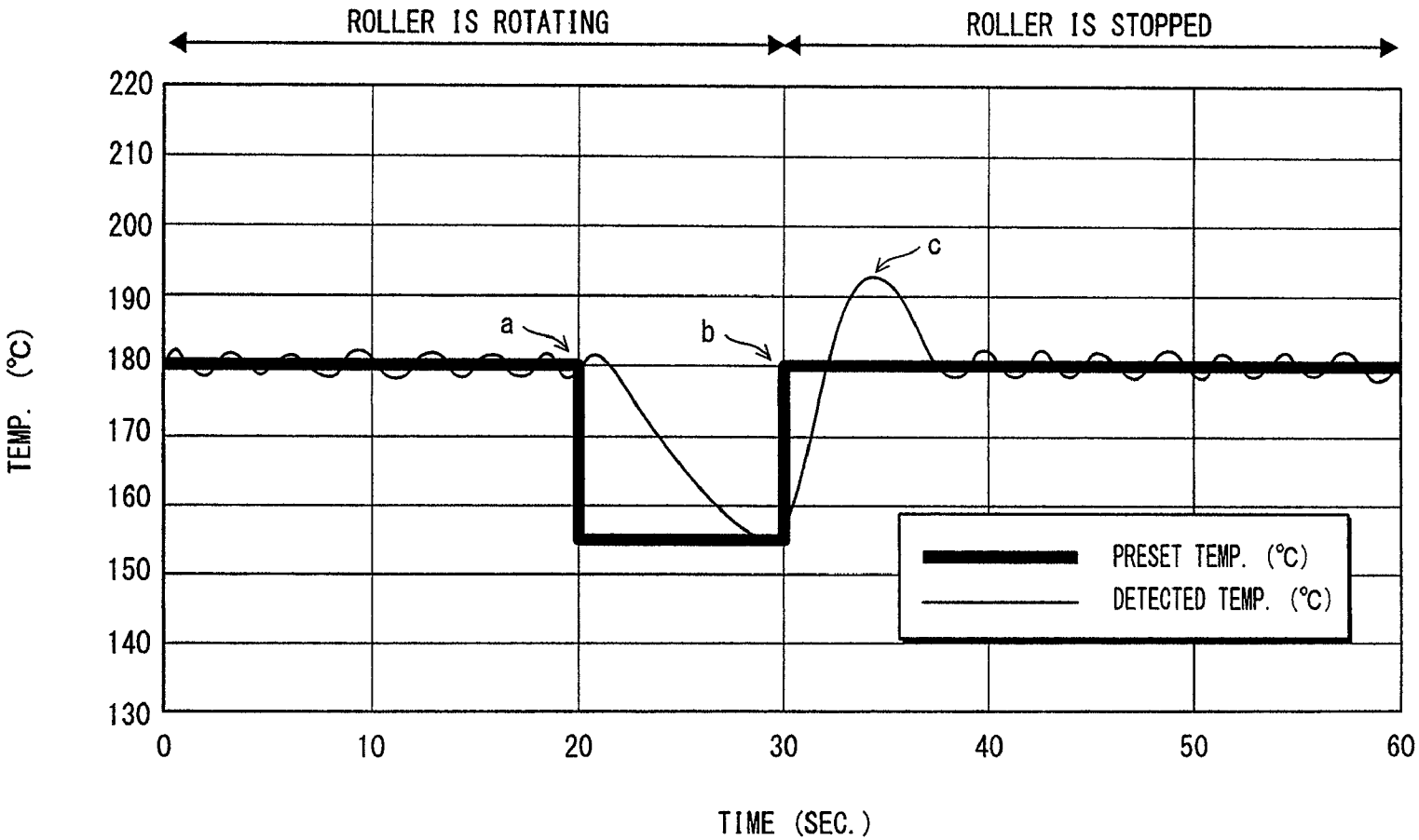
Prior Art FIG. 17
FIG. 17 is a second graph showing transition of a temperature of a roller, according to a conventional image forming device.
Figure 18:
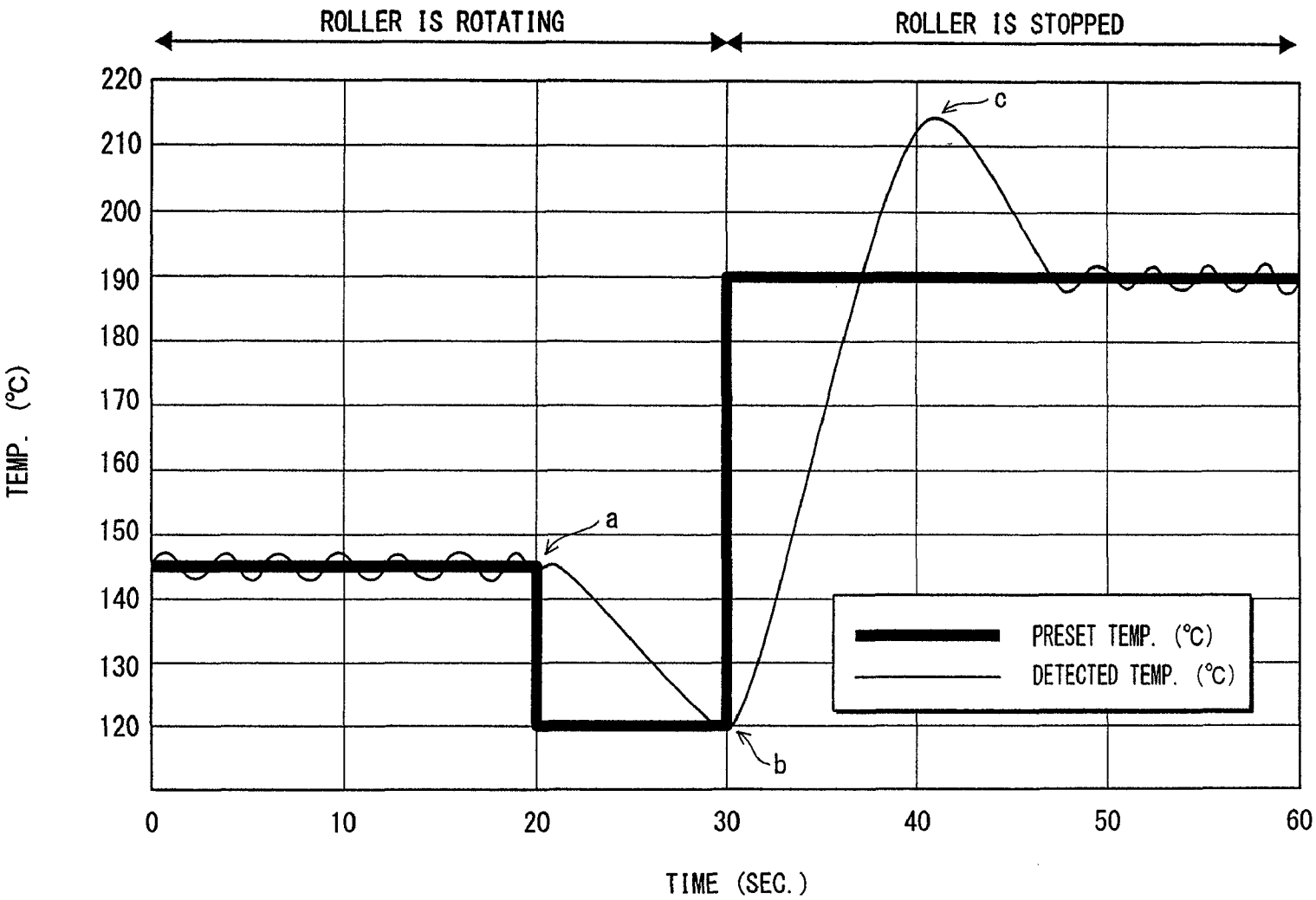
Prior Art FIG. 18
FIG. 18 is a third graph showing transition of a temperature of a roller, according to a conventional image forming device.
Figure 19:
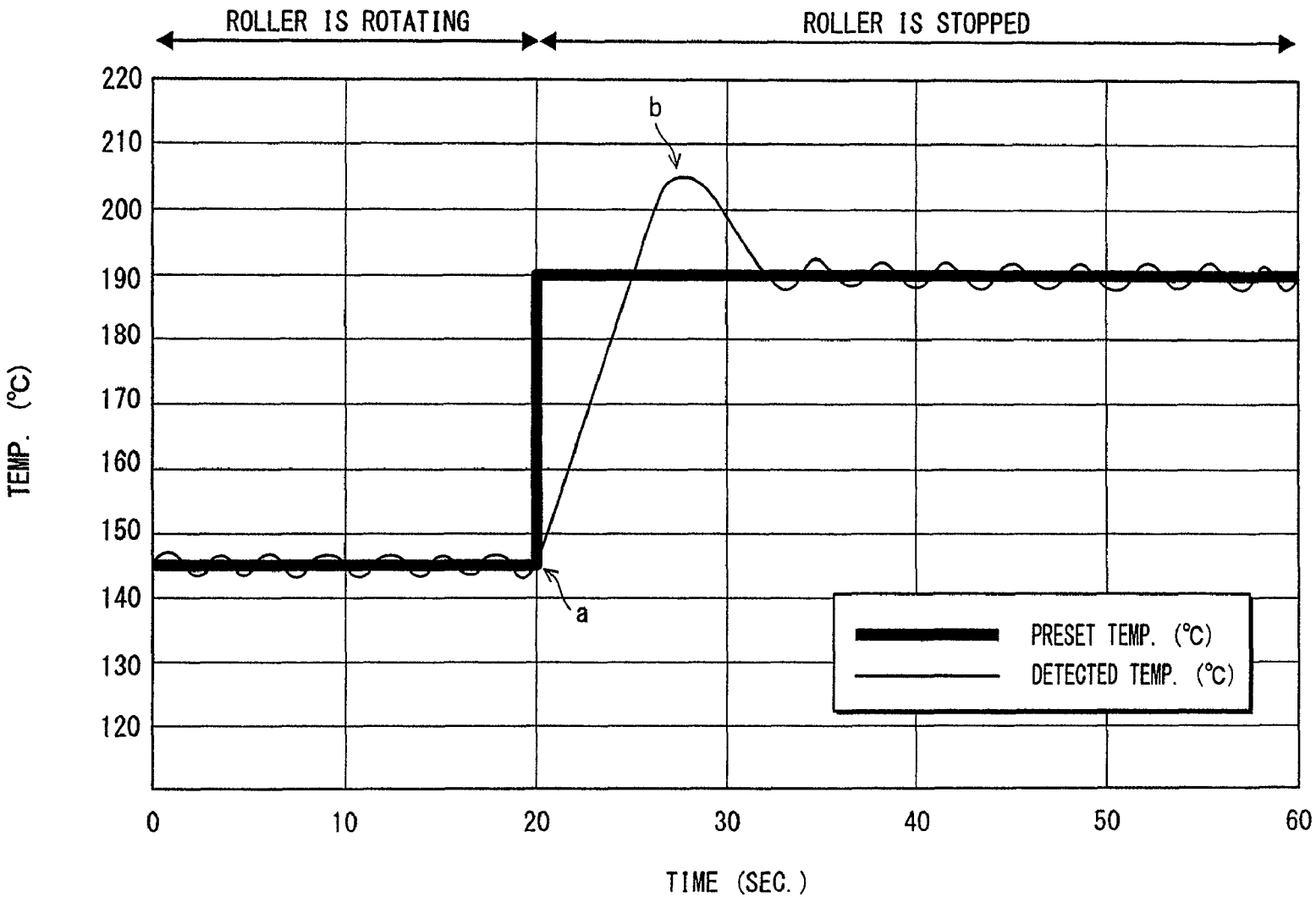
Prior Art FIG. 19
FIG. 19 is a fourth graph showing transition of a temperature of a roller, according to a conventional image forming device.

Described as above, compared with conventional examples shown in FIGS. 16 and 17, according to the image forming device 1, the gap between the overshooting detected temperature and the preset temperature can be reduced.

As a result, according to the image forming device 1, when the low-temperature fixing state is switched to the standby state, since the preset temperature is increased to the standby temperature not sharply but gradually by controlling the temperature once to be kept substantially at a temperature being intermediate between the fixing temperature and the standby temperature, the temperature rise of the rotating member can be suppressed. Accordingly, a peak of the overshoot of the detected temperature occurred at the temperature rise of the roller can be suppressed.

Embodiment 2

Subsequently, a description is made on an image forming device 2 in accordance with Embodiment 2.

Embodiment 1 shows an example in which the CPU 61 control the temperature, in two steps, to be kept at substantially at two intermediate temperatures when the low-temperature fixing state is switched to the standby temperature state, whereas Embodiment 2 shows an example in which the CPU 61 controls the temperature to be kept substantially at one intermediate temperature.

The following describes the image forming device 2, focusing differences from the image forming device 1 of Embodiment 1.

(1. Difference in Structure)

When an image is fixed at a low temperature, the temperature control program 64*b* obtains one intermediate temperature by calculating a temperature being intermediate between the fixing temperature and the standby temperature. The temperature control program 64*b* controls the temperature of the heating roller 51 to be kept substantially at the intermediate temperature by controlling ON/OFF of each of the long heater 55 and the short heater 56. In this embodiment, a value which is the fixing temperature plus 50% of a difference value between the fixing temperature and the standby temperature is given as an example of the intermediate temperature.

(2. Difference in Operation)

Since the warm-up operation of the image forming device 2 is basically identical with that of the image forming device 1, a detailed description thereof is omitted here. With the reference to the flowchart in FIG. 7, a description is made on the operation of the image forming device 2 during and after the image formation.

Figure 7:
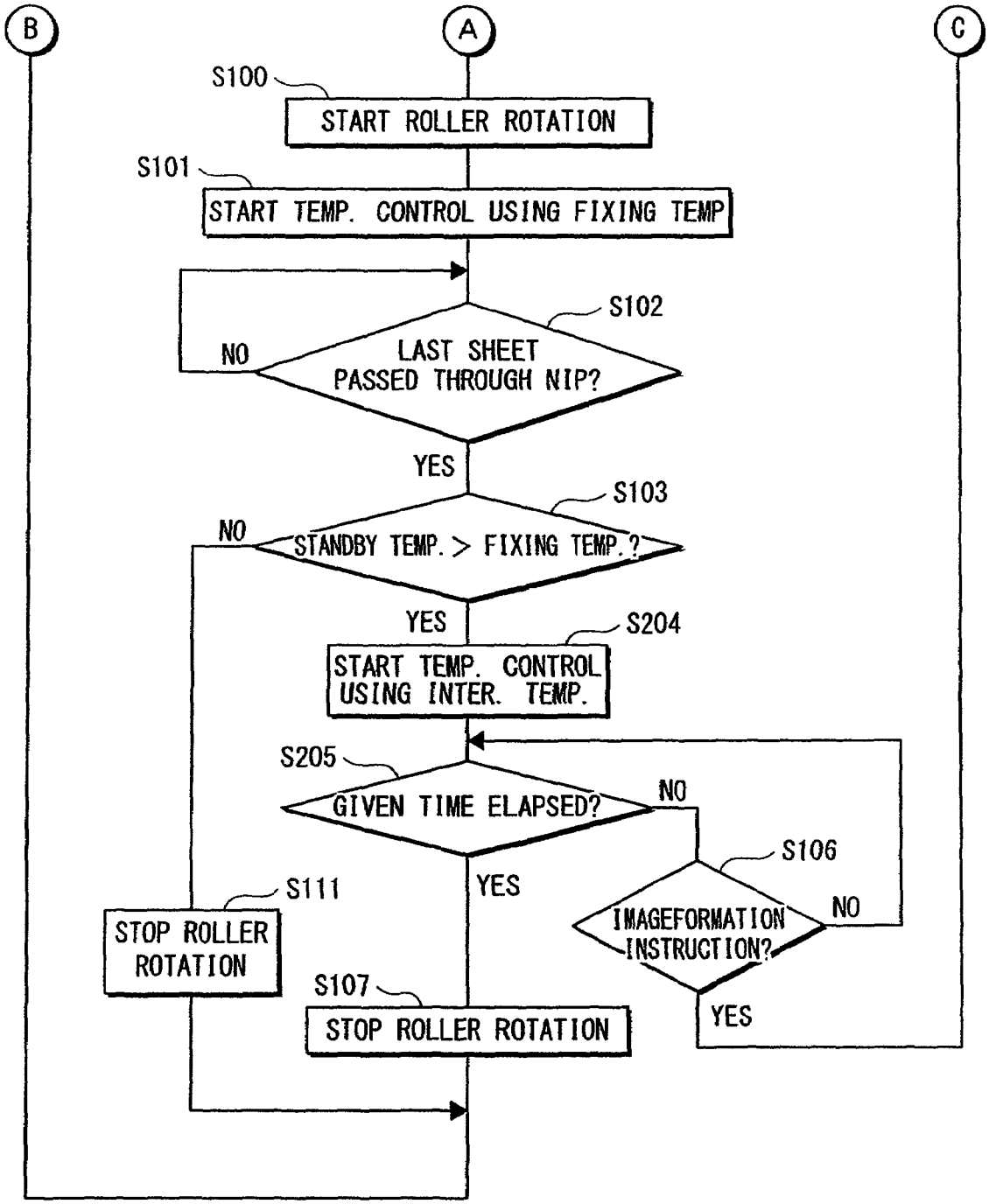
FIG. 7 is a flowchart showing operation during and after the image forming operation, according to an image forming device 2.

As shown in FIG. 7, the operation in Steps S100-S103 of the image forming device 2 is basically identical with that of the image forming device 1.

According to the image forming device 2, following the CPU 61 starts to control the temperature to be kept substantially at the intermediate temperature (Step S204), after a lapse of given time (Step S205: YES), the CPU 61 stops the operation of the heating roller 51 (Step S107). The operation goes to Step S21, switched to be in the standby state.

Figure 8:
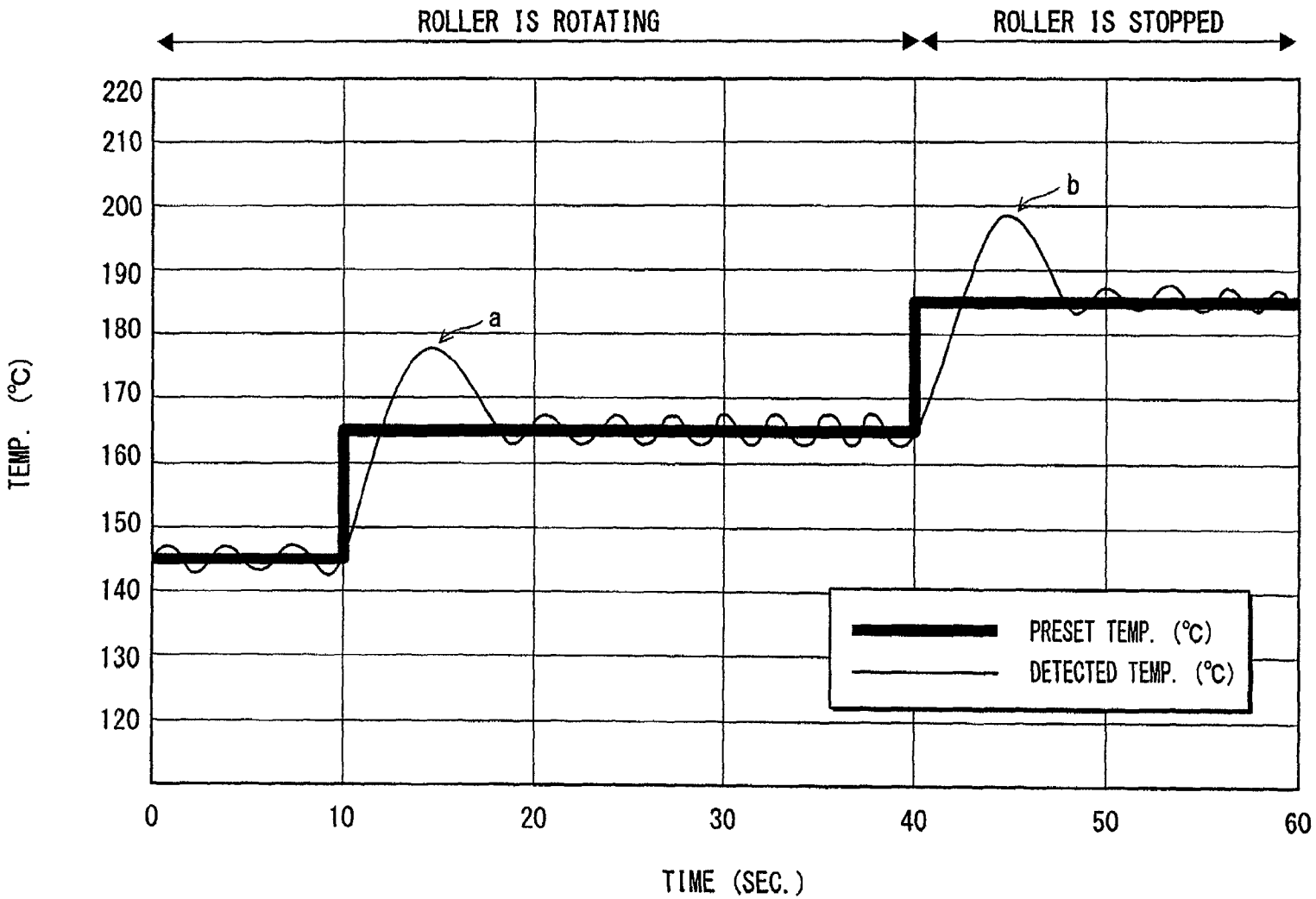
FIG. 8 is a graph showing transition of a temperature of the heating roller 51, according to the image forming device 2.

With the reference to the temperature transition of the heating roller 51 shown in FIG. 8, a description is made on an effect of the operation performed by the image forming device 2.

It is supposed that zero second is set as the starting point, and that the fixing process is completed after ten seconds.

After the completion of the fixing process, the temperature of the heating roller 51 is started to be controlled to be kept substantially at 165° C. which is the preset temperature thereof, with the heating roller 51 being kept rotating. At this time, a large amount of the heat is radiated because the roller is rotating, and the preset temperature is slightly changed by approximately 20° C. from 145° C. to 165° C. Accordingly, although the detected temperature overshoots, a gap between the detected temperature and the preset temperature is suppressed by approximately 10° C. (point a in FIG. 8).

Following this, after a lapse of 30 seconds (equivalent to the given time), the operation is switched to be in the standby state and the temperature is controlled to be kept substantially at 185° C. which is the preset temperature thereof. At this time, since the preset temperature is slightly changed by approximately 20° C. from 165° C. to 185° C., although the detected temperature overshoots, a gap between the detected temperature and the preset temperature is suppressed by approximately 10° C. (point b in FIG. 8).

Described as above, the image forming device 2 controls the temperature to be kept substantially at one intermediate temperature, with the heating roller 51 kept rotating after the fixing process. Thus, compared with conventional examples shown in FIGS. 16 and 17, according to the image forming device 2, when the detected temperature overshoots, the gap between the detected temperature and the preset temperature can be reduced.

Embodiment 3

Subsequently, a description is made on an image forming device 3 in accordance with Embodiment 3.

Embodiment 2 shows an example in which the CPU 61 controls the temperature to be kept substantially at the intermediate temperature, with the heating roller 51 kept rotating when the low-temperature fixing state is switched to the standby temperature state. Embodiment 3 shows an example in which the CPU 61 controls the temperature to be kept substantially at the intermediate temperature, with the heating roller 51 being stopped.

The following describes the image forming device 3, focusing differences from the image forming device 2 of Embodiment 2.

(1. Difference in Operation)

Since the warm-up operation of the image forming device 3 is basically identical with that of the image forming device 2, a detailed description thereof is omitted here. With the reference to the flowchart in FIG. 9, a description is made on the operation of the image forming device 3 during and after the image formation.

Figure 9:
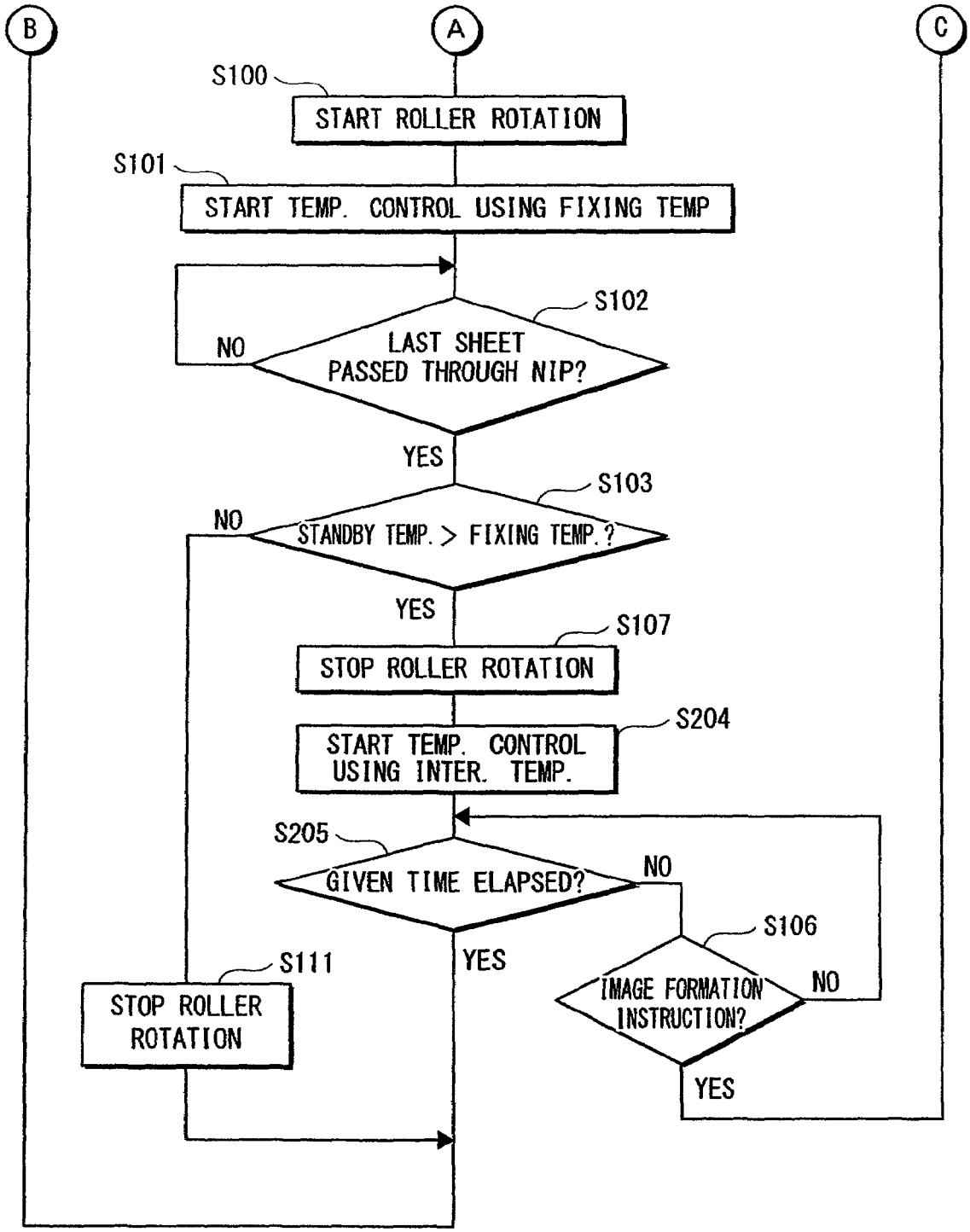
FIG. 9 is a flowchart showing operation during and after the image forming operation, according to an image forming device 3.

As shown in FIG. 9, the operation in Steps S100-S103 of the image forming device 3 is basically identical with that of the image forming device 2.

According to the image forming device 3, when the CPU 61 determines to switch from the low-temperature fixing state in which the fixing temperature is lower than the standby temperature to the standby state (Step S103: YES), the CPU 61 stops the rotation of each of the heating roller 51, fixing roller 52, and the pressure roller 54 (Step S107), and calculates the intermediate temperature. The CPU 61 controls the temperature of the heating roller 51 to be kept substantially at the intermediate temperature (Step S204).

Until given time elapses (Step S205: NO), if the CPU 61 does not receive the execution instruction for image formation (Step S106: NO), the CPU 61 continues to control the temperature to be kept substantially at the intermediate temperature.

After the lapse of the given time (Step S205: YES), the operation goes to Step S21, switched to be in the standby state.

Figure 10:
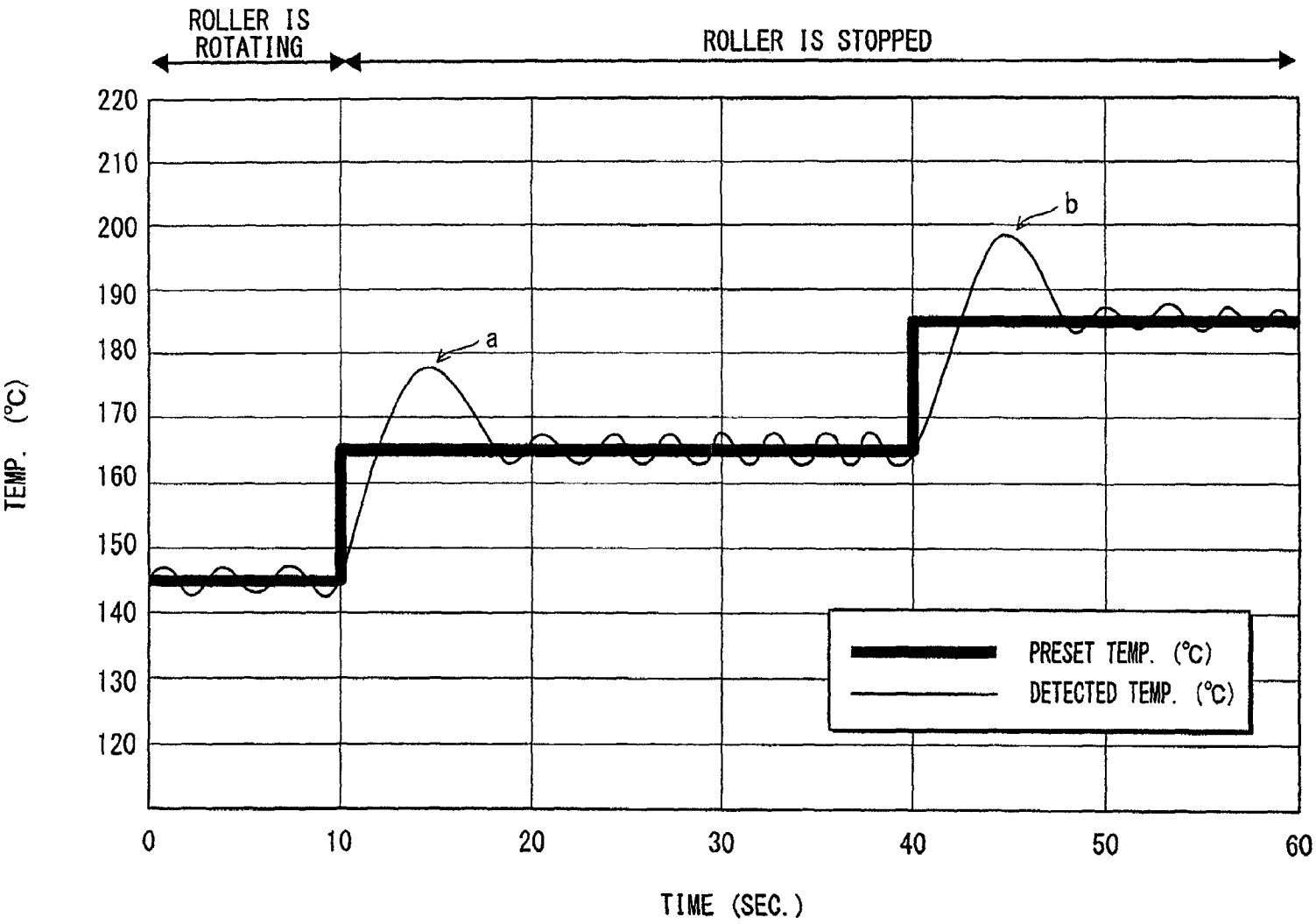
FIG. 10 is a graph showing transition of a temperature of the heating roller 51, according to the image forming device 3.

With the reference to the temperature transition of the heating roller 51 shown in FIG. 10, a description is made on an effect of the operation performed by the image forming device 3.

It is supposed that zero second is set as the starting point, and that the fixing process is completed after ten seconds.

After the completion of the fixing process, the temperature of the heating roller 51 is controlled kept substantially at 165° C. which is the preset temperature thereof, with the rotation of the heating roller 51 being stopped. At this time, the preset temperature is slightly changed by approximately 20° C. from 145° C. to 165° C. Accordingly, although the detected temperature overshoots, a gap between the detected temperature and the preset temperature is suppressed by a little more than 10° C. (point a in FIG. 10).

Following this, after a lapse of 30 seconds (equivalent to the above given time), the operation is switched to be in the standby state, and the temperature is controlled to be kept substantially at 185° C. which is the preset temperature thereof. At this time, since the preset temperature is slightly changed by approximately 20° C. from 165° C. to 185° C., although the detected temperature overshoots, a gap between the detected temperature and the preset temperature is suppressed by approximately 10° C. (point b in FIG. 10).

Described as above, the image forming device 3 stops the rotation of the heating roller 51 immediately after the fixing state is switched to the standby state and controls the temperature to be kept substantially at one intermediate temperature. Thus, compared with the conventional examples shown in FIGS. 16 and 17, according to the image forming device 3, the gap between the detected temperature and the preset temperature can be reduced at the overshoot of the detected temperature.

Embodiment 4

Subsequently, a description is made on an image forming device 4 in accordance with Embodiment 4.

Embodiment 1 shows an example in which the CPU 61 controls the temperature to be kept substantially at the intermediate temperature, regardless of the detected temperature of the heating roller when the fixing temperature is lower than the standby temperature. Embodiment 4 shows an example in which the CPU 61 controls the temperature to be kept substantially at the intermediate temperature only when the detected temperature of the heating roller is lower than a given temperature.

The following describes the image forming device 4, focusing differences from the image forming device 1 of Embodiment 1.

(1. Difference in Structure)

Figure 11:
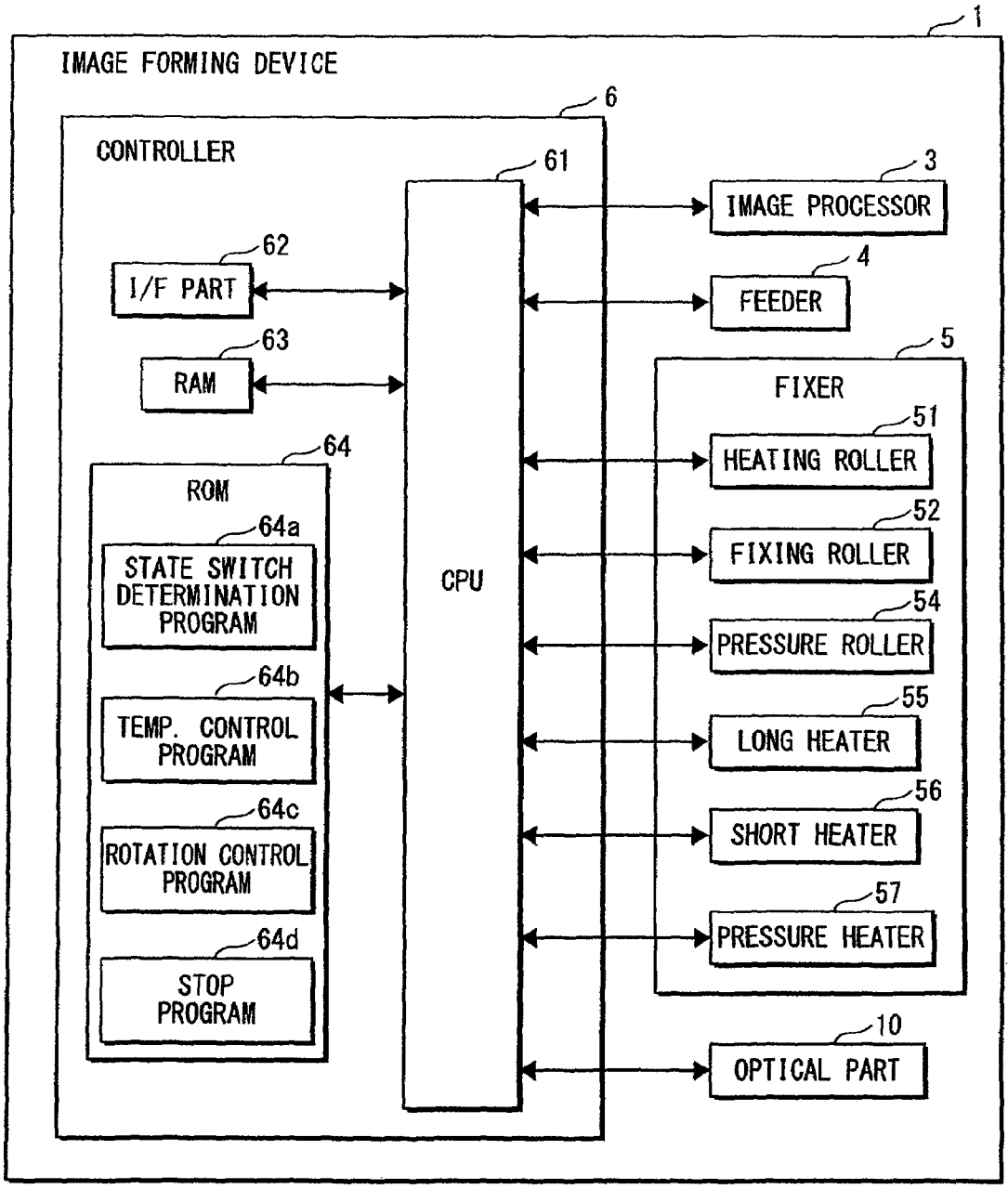
FIG. 11 is a block diagram showing an internal structure of an image forming device 4.

With the reference to the flowchart in FIG. 11, a description is made on an internal structure of the image forming device 4.

Compared to the image forming device 1 of Embodiment 1, a stop program 64*d* is additionally stored in the ROM 64 of the image forming device 4.

When the state switch determination program 64*a* determines that the fixing temperature is lower than the standby temperature, according to the detected temperature of the heating roller side thermistor 58, the stop program 64*d* stops the temperature control program 64*b* from controlling the temperature to be kept substantially at the first intermediate temperature. More specifically, when the detected temperature of the heating roller side thermistor 58 is higher than a given temperature, the temperature control program 64*b* stops controlling the temperature to be kept substantially at the first intermediate temperature.

The given temperature is a detected temperature of the heating roller 51 that can be decreased in the temperature fall when a conventional technique is applied, which may be determined beforehand by experimental measurement. The given temperature may be held by the RAM 63.

(2. Difference in Operation)

Figure 12:
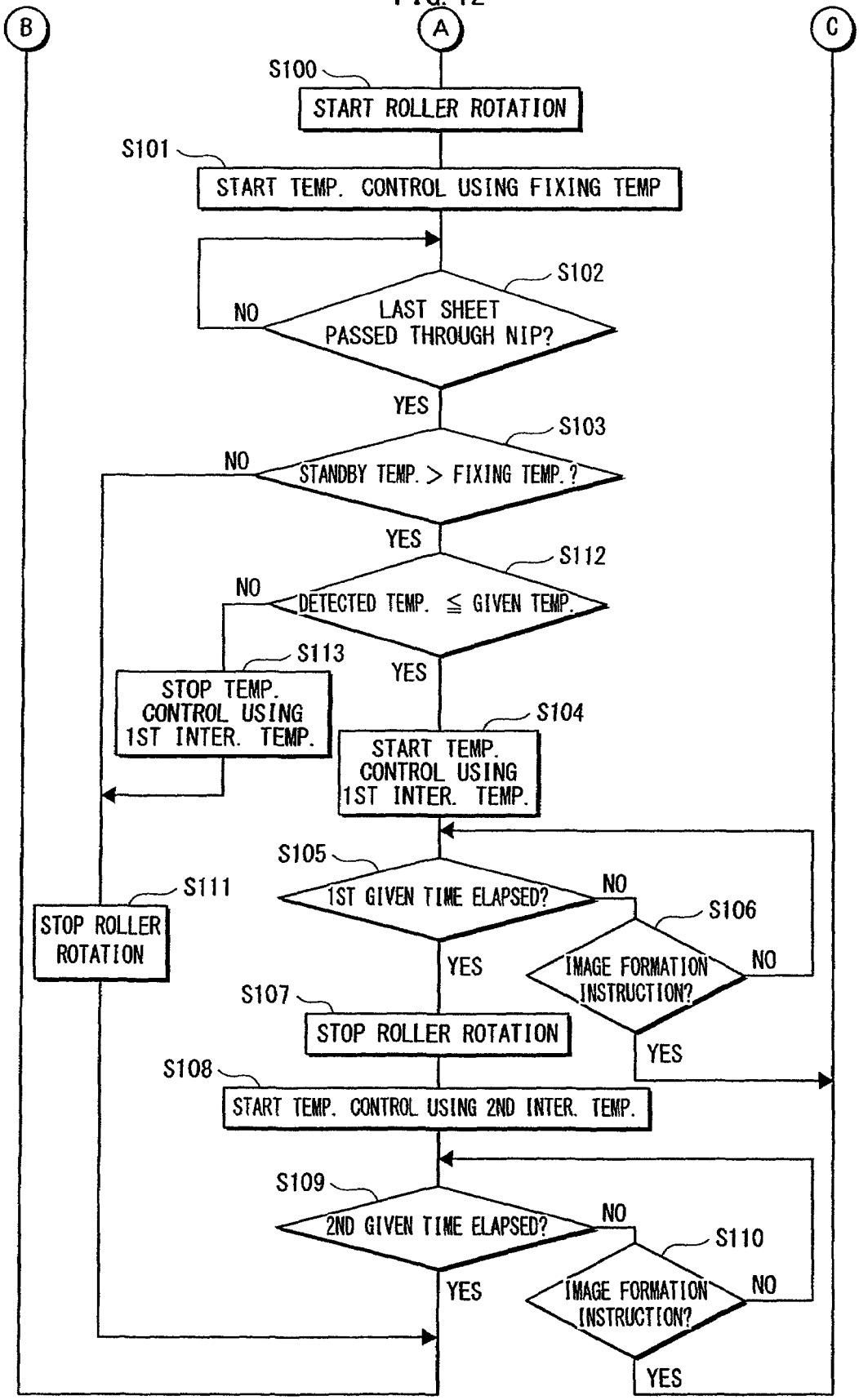
FIG. 12 is a flowchart showing operation during and after the image forming operation, according to the image forming device 4.

Since the warm-up operation of the image forming device 4 is basically identical with that of the image forming device 1, a detailed description thereof is omitted here. With the reference to the flowchart in FIG. 12, a description is made on the operation of the image forming device 4 during and after the image formation. As shown in FIG. 12, the operation in Steps S100-S103 of the image forming device 4 is basically identical with that of the image forming device 1.

According to the image forming device 4, when the CPU 61 determines to switch from the low-temperature fixing state in which the fixing temperature is lower than the standby temperature to the standby state (Step S103: YES), the CPU 61 determines whether the detected temperature of the heating roller side thermistor 58 is equal to or lower than the given temperature (Step S112). When the detected temperature is equal to or lower than the given temperature (Step S112: YES), the CPU 61 controls the temperature to be kept substantially at the first intermediate temperature (Step S104). The operation from Steps S105-S110 is basically identical with that of the image forming device 1.

On the other hand, when the detected temperature is higher than the given temperature (Step S112: NO), the CPU 61 stops controlling the temperature to be kept substantially at the first intermediate temperature (Step S113), and stops the rotation of each of the heating roller 51, the fixing roller 52 and the pressure roller 54 (Step S111).

Described as above, the image forming device 4 controls the temperature to be kept substantially at the first intermediate temperature, as long as the temperature of the heating roller detected by the heating roller side thermistor 58 is equal to or lower than the given temperature.

Thus, when the detected temperature of the heating roller 51 gets extremely low, if the conventional technique is used, the temperature of the heating roller 51 may excessively decrease after the fixing process. However, according to Embodiment 4, such a problem can be avoided. In addition, when the temperature of the heating roller 51 is unproblematically high and when there is not a large gap between the temperature of the heating roller 51 and the standby temperature, the low-temperature fixing state can be promptly switched to the standby state by omitting the control of the temperature to be kept substantially at the first intermediate temperature.

<Modification>

Up to this point, the image forming device of the present invention is described based on Embodiments 1-4. However, various modifications can be made on the features shown in the embodiments.

(1) Embodiment 1 shows an example in which the temperature control program 46*b* calculates the temperature being intermediate between the first WU intermediate temperature and the standby temperature as the second WU intermediate temperature, which is to say, a temperature higher than the first WU intermediate temperature. However, the temperature control program 46*b* may calculate a temperature lower than the first WU intermediate temperature as the second WU intermediate temperature.

In this case, in. Step S108, a temperature subtracted, from the first WU intermediate temperature, approximately 25% of the difference between the first WU intermediate temperature and the fixing temperature may be calculated as the second WU intermediate temperature.

Figure 13:
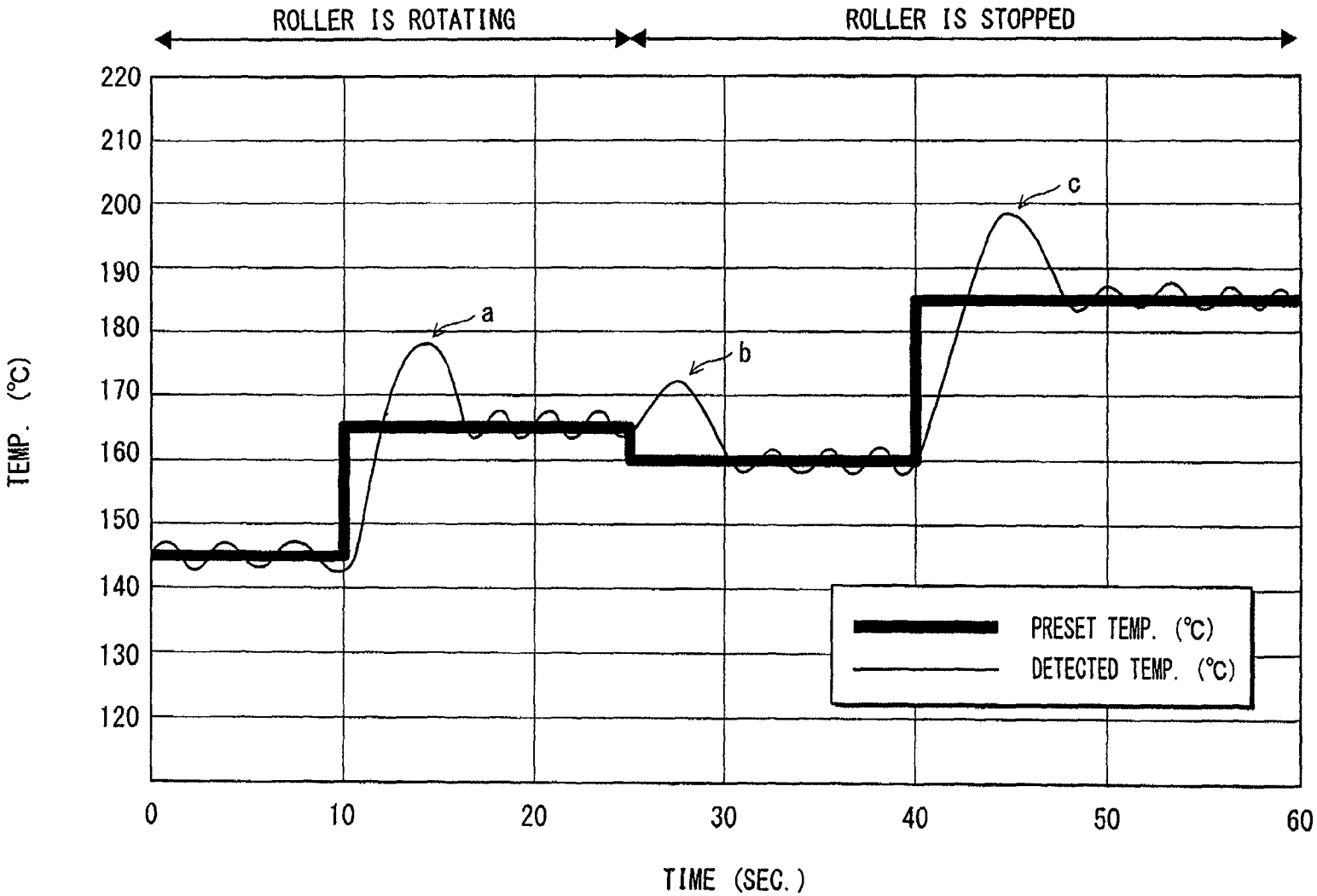
FIG. 13 is a graph showing transition of a temperature of the heating roller 51, according to Modification.

With the reference to FIG. 13, a description is made on temperature transition of the heating roller 51, according to Modification. It is supposed that zero second is set as the starting point, and that the fixing process is completed after ten seconds.

After the completion of the fixing process, the temperature of the heating roller 51 is started to be controlled to be kept substantially at 165° C. which is the preset temperature thereof, with the heating roller 51 kept rotating. At this time, a large amount of the heat is radiated because the roller is rotating, and the preset temperature is slightly changed by approximately 20° C. from 145° C. to 165° C. Accordingly, although the detected temperature overshoots, a gap between the detected temperature and the preset temperature is suppressed by approximately 10° C. (point a in FIG. 13).

Following this, after a lapse of 15 seconds (equivalent to the first given time), the rotation of the heating roller 51 is stopped and the temperature is controlled to be kept substantially at 160° C. which is the preset temperature thereof. Then, although the detected temperature once slightly rises, since the second intermediate temperature is lower than the preset temperature, the detected temperature falls immediately (point b in FIG. 13).

Following this, after a lapse of 15 seconds (equivalent to the second given time), the operation is switched to be in the standby state, and the temperature is controlled to be kept substantially at 185° C. which is the preset temperature thereof. At this time, since the preset temperature is slightly changed by approximately 25° C. from 160° C. to 185° C., although the detected temperature overshoots, a gap between the detected temperature and the preset temperature can be suppressed by approximately 10° C. (point c in FIG. 13).

Modification is effective in the following case. When the temperature is controlled to be changed to the second intermediate temperature (point b in FIG. 13), the temperature may overshoot to a large extent because of the temperature rise due to the stop of the roller.

(2) In Embodiments 2 and 3, the rotation of each of the heating roller 51 is stopped when the operation is switched to be in the standby state, and at the start of the control of the temperature to be kept substantially at the intermediate temperature. However, the rotation of the heating roller 51 may be stopped during the temperature is controlled to be kept substantially at the intermediate temperature.

Figure 14:
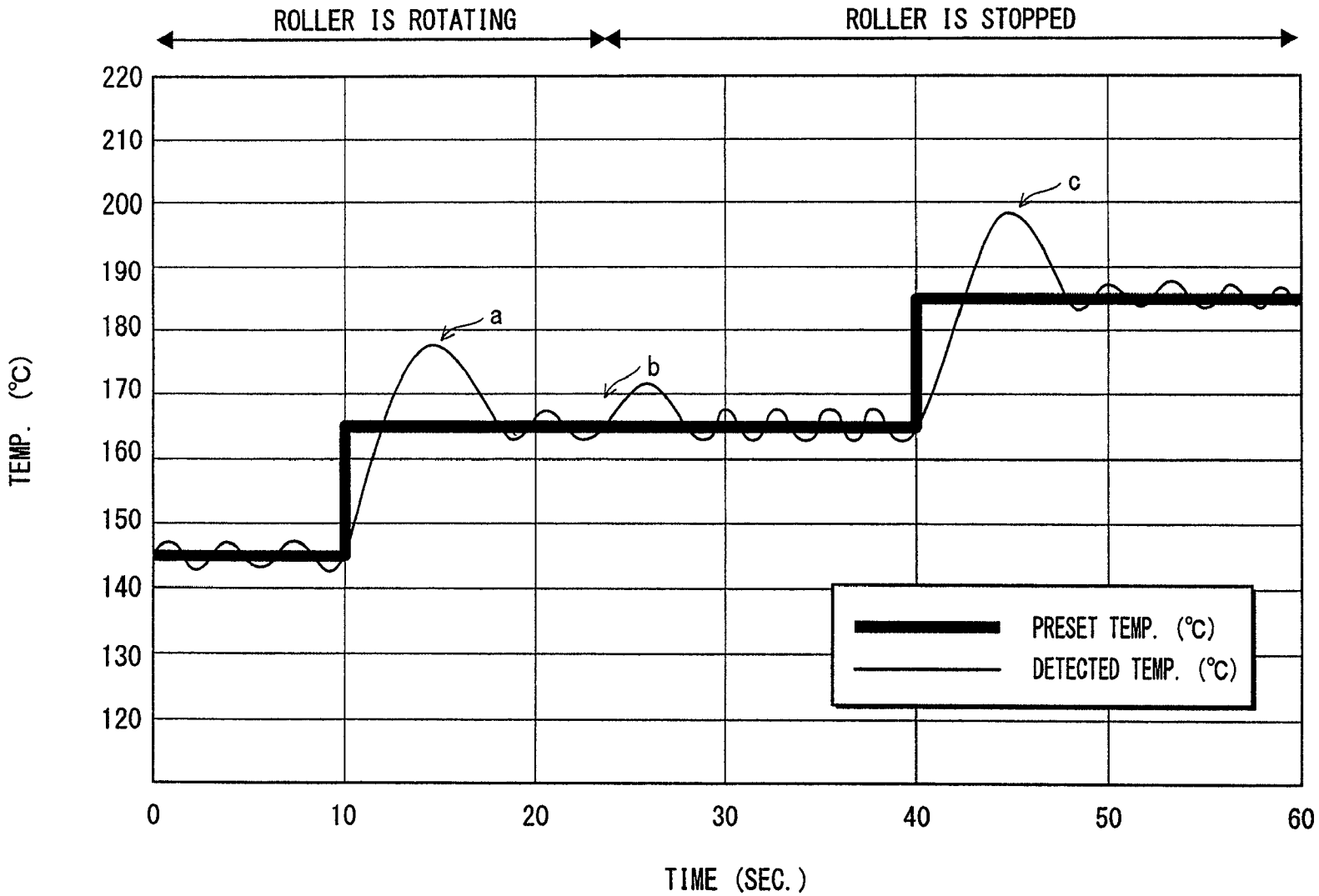
FIG. 14 is a graph showing transition of a temperature of the heating roller 51, according to Modification.

With the reference to FIG. 14, a description is made on temperature transition of the heating roller 51, according to Modification.

The rotation of the heating roller 51 is stopped at a given point (point b in FIG. 14) in midstream of the control of the temperature to be kept substantially at the intermediate temperature. At this time, though the temperature once slightly rises due to the stop of the roller, the temperature falls immediately because the temperature is controlled to be kept substantially at the intermediate temperature.

<Supplement>

The following is a supplementary description of the features shown in Embodiments 1-4 and Modification.

(1) Embodiments 1-4 and Modification each show an example in which the standby temperature is 185° C. and in which the fixing temperature is 145° C. However, the present invention is not limited to this. The fixing temperature and the standby temperature may be any preset temperatures appropriate for the temperature control in the fixing state and in the standby state, respectively.

Particularly, since the fixing temperature is determined according to statuses, such as setting of the image forming device, an environmental temperature, and a type of the sheet S, according to these statuses, a temperature that can obtain the optimum heat fixing may be set as the fixing temperature.

(2) According to Embodiments 1 and 4, the first intermediate temperature and the second intermediate temperature are respectively the fixing temperature plus 10° C. (155° C. ) and the fixing temperature plus 20° C. (165° C. ). According to Embodiments 2-3, the first intermediate temperature is the fixing temperature plus 20° C. (165° C.), for example. However, the present invention is not limited to this. The first intermediate temperature and the second intermediate temperature may be any temperature as long as the temperature is intermediate between the fixing temperature and the standby temperature and is the optimum value for decreasing the peak of the overshooting temperature. The first intermediate temperature and the second intermediate temperature may be determined by experimental measurement, for example.

(3) Embodiments 1 and 4 each show an example in which the first given time and the second given time are each for 10 seconds, and Embodiments 2-3 each show an example in which the first given time is for 30 seconds. However, the present invention is not limited to this. The first given time and the second given time maybe respectively optimum time from the start of the temperature control till the temperature is stabilized to the first intermediate temperature, and to the second intermediate temperature. The first intermediate time and the second intermediate time may be determined by experimental measurement, for example.

(4) Embodiments 1-4 and Modification each show an example in which the temperature of the heating roller 51 is controlled with the use of the long heater 55 or the short heater 56. However, the present invention is not limited to this. When the fixing temperature of the pressure roller 54 can be set in a wide range of temperatures including a lower temperature than the standby temperature, the CPU 61 may control the temperature of the pressure roller 54 as with the heating roller 51. In this case, the CPU 61 controls the temperature of the pressure heater 54 by controlling the pressure heater 57.

Figure 15:
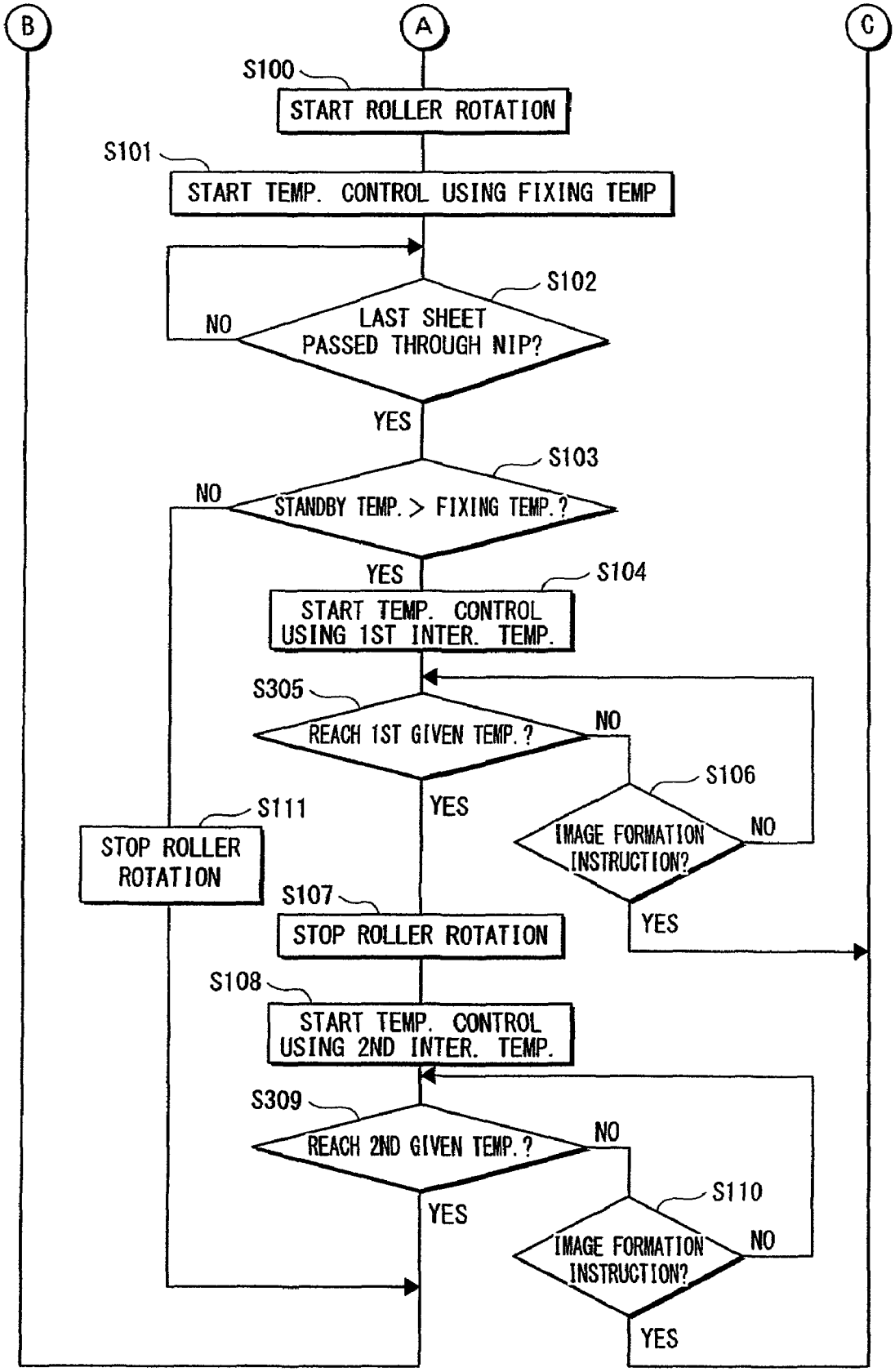
FIG. 15 is a flowchart showing operation during and after the image forming operation, according to Supplement.

(5) According to Embodiments 1-4 and Modification, in Steps S105 and S109, each determination is made based on a lapse of time. The time may be measured actually using a timer and the like, or the lapse of time may be detected by detecting that the number of rotation of the roller or a driving source thereof has reached a given number. In addition, as shown in FIG. 15, Steps S105 and S109 may be replaced by Steps S305 and S309, and each determination may be made based on whether the temperature has reached a given temperature (first given temperature and second given temperature) instead of the lapse of given time. In this case, the given temperature may be a temperature for the temperature control or an arbitrary temperature in the vicinity of the temperature for the temperature control.

Furthermore, a combination of at least two of the lapse of given time, the rotation number and the given temperature may be used for the determination in each step. When one of the conditions of the combination is established, affirmative determination is made.

(6) The state switch determination program 64*a*, the temperature control program 64*b*, and the rotation control program 64*c* shown in Embodiments 1-4 and Modification may be recorded, manufactured and distributed on various types of computer readable recording media including a magnetic tape, a magnetic disk such as a flexible disk, an optical medium such as a DVD-R, a DVD-RW, a DVD-RAM, a DVD+R, a DVD+RW, a CD-R, a CD-RW, and a CD-ROM, an MO, and a PD, and a flash memory recording medium.

In addition, the state switch determination program 64*a*, the temperature control program 64*b*, and the rotation control program 64*c* may be transmitted via network such as internet, broadcasting, telecommunication line, satellite communication and the like.

<Conclusion>

The aforementioned embodiments and modification show one aspect for solving the problems described in the prior art section, and can be summarized as follows.

An image forming device that thermally fixes an unfixed image onto a recording sheet having the unfixed image formed thereon, by passing the recording sheet through a fixing nip between a pair of rotating members for applying pressure to the recording sheet. In a standby state, rotation of the pair of the rotating members is controlled to stop, and a temperature of at least one of the pair of the rotating members is controlled to be kept substantially at a given standby temperature, and in a low-temperature fixing state, the pair of the rotating members is controlled to rotate, and the temperature is controlled to be kept substantially at a lower temperature than the standby temperature. The image forming device includes a determiner operable to determine whether to switch from the low-temperature fixing state to the standby state, and a controller operable, if the determination is affirmative, to control the temperature to be kept substantially at a temperature being intermediate between the lower temperature and the standby temperature, and subsequently to control the temperature to be kept substantially at the standby temperature.

An image forming method used by an image forming device that thermally fixes an unfixed image onto a recording sheet having the unfixed image formed thereon, by passing the recording sheet through a fixing nip between a pair of rotating members for applying pressure to the recording sheet. In a standby state, rotation of the pair of the rotating members is controlled to stop, and a temperature of at least one of the pair of the rotating members is controlled to be kept substantially at a given standby temperature, and in a low-temperature fixing state, the pair of the rotating members is controlled to rotate, and the temperature is controlled to be kept substantially at a lower temperature than the standby temperature. The image forming method includes a determination step of determining whether to switch from the low-temperature fixing state to the standby state, and a control step of, if the determination is affirmative, controlling the temperature to be kept substantially at a temperature being intermediate between the lower temperature and the standby temperature, and subsequently controlling the temperature to be kept substantially at the standby temperature.

With the above features, when the low-temperature fixing state where the fixing temperature is lower than the standby temperature is switched to the standby state, the image forming device controls the temperature to be kept substantially at a temperature being intermediate between the fixing temperature and the standby temperature. The preset temperature is increased to the standby temperature not sharply but gradually as follows. The preset temperature is increased to the intermediate temperature, and subsequently, the intermediate temperature is further increased to the standby temperature. Thus, the overshoot that occurs at the temperature rise of the rotating member can be suppressed because the preset temperature is gradually raised. As a result, the deterioration of the members in the vicinity of the roller is also suppressed.

In a high-temperature fixing state, the pair of the rotating members is controlled to rotate, and the temperature is controlled to be kept substantially at a temperature higher than or equal to the standby temperature. The determiner includes a first determiner operable to determine whether a last one of recording sheets on each of which an image is formed has passed through the fixing nip, and a second determiner operable to determine whether the control of the rotation and the temperature is performed in the low-temperature fixing state or the high-temperature fixing state. The determiner determines in affirmative when the first determiner determines in affirmative and when the second determiner determines the control of the rotation and the temperature is performed in the low-temperature fixing state.

In a high-temperature fixing state, the pair of the rotating members is controlled to rotate, and the temperature is controlled to be kept substantially at a temperature higher than or equal to the standby temperature. The determination step includes a first determination sub-step of determining whether a last one of recording sheets on each of which an image is formed has passed through the fixing nip, and a second determination sub-step of determining whether the control of the rotation and the temperature is performed in the low-temperature fixing state or the high-temperature fixing state. The determination step determines in affirmative when first determination sub-step determines in affirmative and when the second determination sub-step determines the control of the rotation and the temperature is performed in the low-temperature fixing state.

With the above features, when there are low-temperature fixing state and the high-temperature fixing state, the image processing device determines that the low-temperature fixing state should be switched to the standby state, based on whether the last recording sheet on which an image is formed has passed through the fixing nip and whether the control is performed in the low-temperature fixing state.

The controller (i) keeps the pair of the rotating members rotating while the temperature is controlled to be kept substantially at the intermediate temperature, and (ii) stops the rotation after a lapse of given time or when the temperature has reached the standby temperature.

The control step (i) keeps the pair of the rotating members rotating while the temperature is controlled to be kept substantially at the intermediate temperature, and (ii) stops the rotation after a lapse of given time or when the temperature has reached the standby temperature.

With the above features, when the low-temperature state is switched to the standby state, the image forming device does not immediately stop the rotation, and keeps the rotation of while the temperature is controlled to be kept substantially at the intermediate temperature. This can prevents a severe temperature rise in the rotating member due to after heat of the rotating member immediately after the fixing process.

The controller (i) keeps the pair of the rotating members rotating, and controls the temperature to be kept substantially at the intermediate temperature, (ii) stops the rotation after a lapse of given time or after the temperature has reached a given temperature, and controls the temperature to be kept substantially at a secondary intermediate temperature that is higher than or equal to the lower temperature and that is lower than the standby temperature, and (iii) controls the temperature to be kept substantially at the standby temperature.

The control step (i) keeps the pair of the rotating members rotating, and controls the temperature to be kept substantially at the intermediate temperature, (ii) stops the rotation after a lapse of given time or after the temperature has reached a given temperature, and controls the temperature to be kept substantially at a secondary intermediate temperature that is higher than or equal to the lower temperature and that is lower than the standby temperature, and (iii) controls the temperature to be kept substantially at the standby temperature.

With the above features, when the low-temperature state is switched to the standby state, the image forming device does not immediately stop the rotation, and keeps the rotation of the rotating member and controls the temperature to be kept substantially at the intermediate temperature. Following this, the image forming device stops the rotation and controls the temperature to be kept substantially at the secondary intermediate temperature, and then the temperature is controlled to be kept substantially at the standby temperature. At this time, by gradually raising or decreasing the preset temperature, the overshoot occurred at the temperature rise of the rotating member and the overshoot occurred at the stop of the rotating member can be further suppressed.

The image forming device further includes a temperature detector operable to detect a temperature of the one of the pair of the rotating members, and a stop part operable, if the determination is affirmative, to stop the temperature control when the detected temperature is higher than a given temperature.

The image forming method further includes a temperature detection step of detecting a temperature of the one of the pair of the rotating members, and a stop step of, if the determination is affirmative, stopping the temperature control when the detected temperature is higher than a given temperature.

With the above features, when the detected temperature of the one of the rotating members is fairly high and when there is not a large gap between the detected temperature and the standby temperature, the image forming device does not control the temperature to be kept substantially at the intermediate temperature. Thus, the low-temperature fixing state can be swiftly switched to the standby state.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

INDUSTRIAL APPLICABILITY

The present invention is widely applicable to an image forming device that forms an unfixed image on a recording sheet having the unfixed image transferred thereto by thermally fixing the unfixed image thereon.

What is claimed is:

1. An image forming device that thermally fixes an unfixed image onto a recording sheet having the unfixed image formed thereon, by passing the recording sheet through a fixing nip between a pair of rotating members for applying pressure to the recording sheet, wherein in a standby state, rotation of the pair of the rotating members is controlled to stop, and a temperature of at least one of the pair of the rotating members is controlled to be kept at a given standby temperature, and in a low-temperature fixing state, the pair of the rotating members is controlled to rotate, and the temperature is controlled to be kept at a temperature lower than the standby temperature, in a high-temperature fixing state, the pair of the rotating members is controlled to rotate, and the temperature is controlled to be kept at a temperature higher than or equal to the standby temperature, the image forming device comprises:

a determiner comprising:

a first determiner operable to determine whether a last of a plurality of recording sheets on which an image is formed has passed through the fixing nip; and a second determiner operable to determine whether the control of the rotation and the temperature is performed in the low-temperature fixing state or the high-temperature fixing state wherein the determiner determines in affirmative when the first determiner determines in affirmative and when the second determiner determines the control of the rotation and the temperature is performed in the low-temperature fixing state; and a controller operable, if the determination by the determiner is affirmative, to control the temperature to be kept at a temperature being intermediate between the lower temperature and the standby temperature, and subsequently to control the temperature to be kept at the standby temperature.

2. The image forming device of claim 1, wherein the controller (i) keeps the pair of the rotating members rotating while the temperature is controlled to be kept substantially at the intermediate temperature, and (ii) stops the rotation after a lapse of given time or when the temperature has reached the standby temperature.

3. The image forming device of claim 1, wherein the controller (i) keeps the pair of the rotating members rotating, and controls the temperature to be kept substantially at the intermediate temperature, (ii) stops the rotation after a lapse of given time or after the temperature has reached a given temperature, and controls the temperature to be kept substantially at a secondary intermediate temperature that is higher than or equal to the lower temperature and that is lower than the standby temperature, and (iii) controls the temperature to be kept substantially at the standby temperature.

4. The image forming device of claim 1, further comprising:

a temperature detector operable to detect a temperature of the one of the pair of the rotating members; and a stop part operable, if the determination is affirmative, to stop the temperature control when the detected temperature is higher than a given temperature.

5. An image forming method used by an image forming device that thermally fixes an unfixed image onto a recording sheet having the unfixed image formed thereon, by passing the recording sheet through a fixing nip between a pair of rotating members for applying pressure to the recording sheet, wherein in a standby state, rotation of the pair of the rotating members is controlled to stop, and a temperature of at least one of the pair of the rotating members is controlled to be kept at a given standby temperature, and in a low-temperature fixing state, the pair of the rotating members is controlled to rotate, and the temperature is controlled to be kept at a temperature lower than the standby temperature, in a high-temperature fixing state, the pair of the rotating members is controlled to rotate, and the temperature is controlled to be kept at a temperature higher than or equal to the standby temperature, the image forming method comprises:

a determination step comprising: and a first determination sub-step of determining whether a last of a plurality of recording sheets on which an image is formed has passed through the fixing nip;

a second determination sub-step of determining whether the control of the rotation and the temperature is performed in the low-temperature fixing state or the high-temperature fixing state, and the determination step determines in affirmative when first determination sub-step determines in affirmative and when the second determination sub-step determines the control of the rotation and the temperature is performed in the low-temperature fixing state; and a control step of, if the determination by the determiner is affirmative, controlling the temperature to be kept at a temperature being intermediate between the lower temperature and the standby temperature, and subsequently controlling the temperature to be kept substantially at the standby temperature.

6. The image forming method of claim 5, wherein the control step (i) keeps the pair of the rotating members rotating while the temperature is controlled to be kept substantially at the intermediate temperature, and (ii) stops the rotation after a lapse of given time or when the temperature has reached the standby temperature.

7. The image forming method of claim 5, wherein the control step (i) keeps the pair of the rotating members rotating, and controls the temperature to be kept substantially at the intermediate temperature, (ii) stops the rotation after a lapse of given time or after the temperature has reached a given temperature, and controls the temperature to be kept substantially at a secondary intermediate temperature that is higher than or equal to the lower temperature and that is lower than the standby temperature, and (iii) controls the temperature to be kept substantially at the standby temperature.

8. The image forming method of claim 5, further comprising:

a temperature detection step of detecting a temperature of the one of the pair of the rotating members; and a stop step of, if the determination is affirmative, stopping the temperature control when the detected temperature is higher than a given temperature.

9. A program embodied on a non-transitory computer readable medium utilized by an image forming device that thermally fixes an unfixed image onto a recording sheet having the unfixed image formed thereon, by passing the recording sheet through a fixing nip between a pair of rotating members for applying pressure to the recording sheet, wherein in a standby state, rotation of the pair of the rotating members is controlled to stop, and a temperature of at least one of the pair of the rotating members is controlled to be kept at a given standby temperature, and in a low-temperature fixing state, the pair of the rotating members is controlled to rotate, and the temperature is controlled to be kept at a temperature lower than the standby temperature, in a high-temperature fixing state, the pair of the rotating members is controlled to rotate, and the temperature is controlled to be kept at a temperature higher than or equal to the standby temperature, the program executes processing including the steps of:

a determination step comprising:

a first determination sub-step of determining whether a last of a plurality of recording sheets on which an image is formed has passed through the fixing nip;

a second determination sub-step of determining whether the control of the rotation and the temperature is performed in the low-temperature fixing state or the high-temperature fixing state, and the determination step determines in affirmative when first determination sub-step determines in affirmative and when the second determination sub-step determines the control of the rotation and the temperature is performed in the low-temperature fixing state; and a control step of, if the determination by the determiner is affirmative, controlling the temperature to be kept at a temperature being intermediate between the lower temperature and the standby temperature, and subsequently controlling the temperature to be kept substantially at the standby temperature.

10. The program of claim 9, wherein the control step (i) keeps the pair of the rotating members rotating while the temperature is controlled to be kept substantially at the intermediate temperature, and (ii) stops the rotation after a lapse of given time or when the temperature has reached the standby temperature.

11. The program of claim 9, wherein the control step (i) keeps the pair of the rotating members rotating, and controls the temperature to be kept substantially at the intermediate temperature, (ii) stops the rotation after a lapse of given time or after the temperature has reached a given temperature, and controls the temperature to be kept substantially at a secondary intermediate temperature that is higher than or equal to the lower temperature and that is lower than the standby temperature, and (iii) controls the temperature to be kept substantially at the standby temperature.

12. The program of claim 9, further comprising:

a temperature detection step of detecting a temperature of the one of the pair of the rotating members; and a stop step, if the determination is affirmative, of stopping the temperature control when the detected temperature is higher than a given temperature.

* * * * *